US011462152B2

(12) United States Patent
Kim et al.

(10) Patent No.: US 11,462,152 B2
(45) **Date of Patent: *Oct. 4, 2022**

(54) PIXEL AND DISPLAY DEVICE HAVING THE SAME

(71) Applicant: SAMSUNG DISPLAY CO., LTD., Yongin-si (KR)

(72) Inventors: Yun Seong Kim, Yongin-si (KR); Seung Kyu Lee, Yongin-si (KR); Sun Joon Hwang, Yongin-si (KR); Min Seong Son, Yongin-si (KR); Youn Woo Choe, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/380,342

(22) Filed: Jul. 20, 2021

(65) Prior Publication Data

US 2022/0028329 A1 Jan. 27, 2022

(30) Foreign Application Priority Data

Jul. 23, 2020 (KR) ..... 10-2020-0091873

(51) Int. Cl.
*G09G 3/32* (2016.01)

(52) U.S. Cl.
CPC ..... *G09G 3/32* (2013.01); *G09G 2310/0278* (2013.01); *G09G 2310/08* (2013.01); *G09G 2330/028* (2013.01)

(58) Field of Classification Search
CPC ... G09G 3/32–3291; G09G 2300/0426; G09G 2300/0439; G09G 2300/0809; G09G 2300/0819; G09G 2300/0842; G09G 2300/0861; G09G 2300/0871; G09G 2310/0202; G09G 2310/0205; G09G 2310/0243; G09G 2310/0262; G09G 2310/0267; G09G 2310/027–0278;
(Continued)

(56) References Cited

U.S. PATENT DOCUMENTS 7,414,599 B2 8/2008 Chung et al.
8,456,397 B2 6/2013 Kim et al.
(Continued)

FOREIGN PATENT DOCUMENTS

KR 100560780 B1 3/2006
KR 1020140013586 A 2/2014
(Continued)

*Primary Examiner* — Nathan Danielsen
(74) *Attorney, Agent, or Firm* — Cantor Colburn LLP

(57) ABSTRACT

A display device includes: a pixel including a first transistor connected between a first node and a second node to generate a driving current; an emission driver supplying an emission control signal; a scan driver supplying first to fourth scan signals in a period in which the emission control signal is supplied; a data drive supplying a data signal; a power supply supplying a voltage of a first power source; and a timing controller controlling driving of the scan driver, the emission driver, the data driver, and the power supply The first scan signal controls a timing at which the voltage of the first power source is supplied to the first node or the second node. The power supply changes a level of the voltage of the first power source in one frame period.

20 Claims, 18 Drawing Sheets

(58) Field of Classification Search
CPC ..... G09G 2310/06; G09G 2310/08; G09G 2320/02; G09G 2320/0233; G09G 2320/0242; G09G 2320/0247; G09G 2320/0257; G09G 2330/02; G09G 2330/028
See application file for complete search history.

(56) References Cited

U.S. PATENT DOCUMENTS

| | | | | |
|---|---|---|---|---|
| 9,024,934 | B2 | 5/2015 | Park et al. | |
| 9,373,662 | B2 | 6/2016 | Her et al. | |
| 9,824,632 | B2 | 11/2017 | Chaji et al. | |
| 10,255,855 | B2 | 4/2019 | Park et al. | |
| 10,475,386 | B2 | 11/2019 | Kim et al. | |
| 11,056,060 | B2 | 7/2021 | Kim et al. | |
| 2006/0221005 | A1* | 10/2006 | Omata | G09G 3/3241 345/76 |
| 2013/0169702 | A1 | 7/2013 | Ono | |
| 2016/0365035 | A1 | 12/2016 | Park | |
| 2017/0193918 | A1 | 7/2017 | Bae | |
| 2018/0190196 | A1* | 7/2018 | Kwon | G09G 3/3233 |
| 2018/0308918 | A1* | 10/2018 | Choi | G09G 3/3233 |
| 2020/0394961 | A1* | 12/2020 | Kim | G09G 3/3233 |
| 2021/0027696 | A1* | 1/2021 | Kim | G09G 3/3233 |
| 2021/0049965 | A1 | 2/2021 | Jeon et al. | |
| 2022/0028329 | A1 | 1/2022 | Kim et al. | |

FOREIGN PATENT DOCUMENTS

| | | | |
|---|---|---|---|
| KR | 101490894 | B1 | 2/2015 |
| KR | 1020160052844 | A | 5/2016 |
| KR | 1020170049787 | A | 5/2017 |
| KR | 1020190002940 | A | 1/2019 |
| KR | 1020200142646 | A | 12/2020 |

* cited by examiner

PIXEL AND DISPLAY DEVICE HAVING THE SAME

This application claims priority to Korean patent application 10-2020-0091873 filed on Jul. 23, 2020, and all the benefits accruing therefrom under 35 U.S.C. § 119, the content of which in its entirety is herein incorporated by reference.

BACKGROUND

1. Technical Field

The present disclosure generally relates to a pixel and a display device having the same.

2. Related Art

A display device displays an image by using control signals applied from the outside.

The display device includes a plurality of pixels. Each of the pixels includes a plurality of transistors, a light emitting element electrically connected to the transistors, and a capacitor. The transistors are turned on in response to signals provided through a line, and accordingly, a predetermined driving current is generated. The light emitting element emits light, corresponding to the driving current.

A display device of low power consumption is under development so as to improve the driving efficiency of the display device. For example, the power consumption of the display device may be reduced by lowering a driving frequency (or data write frequency) when a still image is displayed. In addition, the display device may display an image at various frame frequencies (or driving frequencies) so as to achieve image display in various conditions. Accordingly, a method is required, which can improve display quality when the display device is driven by changing a frame frequency.

SUMMARY

Embodiments provide a pixel in which display quality deterioration due to a change in hysteresis characteristic of a driving transistor is effectively prevented (i.e., eliminated).

Embodiments also provide a display device including the pixel.

In accordance with an aspect of the present disclosure, there is provided a pixel including: a light emitting element; a first transistor connected between a first node and a second node and which controls a driving current supplied to the light emitting element, according to a voltage of a third node connected to a gate electrode of the first transistor; a second transistor connected between a data line and the first node and which is turned on in response to a fourth scan signal; a third transistor connected between the second node and the third node and which is turned on in response to a second scan signal; a fourth transistor which is turned on in response to a first scan signal to apply a voltage of a first power source to the first transistor; a fifth transistor connected between a driving power source and the first node and which is turned off in response to an emission control signal; a sixth transistor connected between the second node and a first electrode of the light emitting element and which is turned off in response to the emission control signal; and a seventh transistor connected between the third node and a second power source and which is turned on in response to a third scan signal, where a level of the voltage of the first power source is changed in one frame period.

The one frame period may include: a display scan period in which the fourth scan signal is supplied to the second transistor such that a data signal supplied through the data line is written to the first node, and the first scan signal is supplied to the fourth transistor; and at least one bias scan period in which the fourth scan signal is not supplied to the second transistor, and the first scan signal is supplied to the fourth transistor.

The first power source may have a first voltage level in the display scan period, and have a second voltage level different from the first voltage level in the at least one bias scan period.

The at least one bias scan period may include a first bias scan period and a second bias scan period after the first bias scan period. The first power source may have a first voltage level in the display scan period, have a second voltage level different from the first voltage level in the first bias scan period, and have a third voltage level different from each of the first voltage level and the second voltage level in the second bias scan period.

The data signal supplied through the data line may have a fourth voltage level in the display scan period, and have a fifth voltage level different from the fourth voltage level in the at least one bias scan period.

The data signal supplied through the data line may have a fourth voltage level in the display scan period, have a fifth voltage level different from the fourth voltage level in the first bias scan period, and have a sixth voltage level different from each of the fourth voltage level and the fifth voltage level in the second bias scan period.

The pixel may further include an eighth transistor connected between the first electrode of the light emitting element and a third power source and which is turned on in response to the first scan signal. The third power source may have a seventh voltage level in the display scan period, and have an eighth voltage level different from the seventh voltage level in the at least one bias scan period.

The pixel may further include an eighth transistor connected between the first electrode of the light emitting element and a third power source and which is turned on in response to the first scan signal. The third power source may have a seventh voltage level in the display scan period, have an eighth voltage level different from the seventh voltage level in the first bias scan period, and have a ninth voltage level different from each of the seventh voltage level and the eighth voltage level in the second bias scan period.

One electrode of the fourth transistor may be connected to the first node.

One electrode of the fourth transistor may be connected to the second node.

In accordance with another aspect of the present disclosure, there is provided a display device including: a pixel including a first transistor connected between a first node and a second node to generate a driving current, where the pixel is connected to a first scan line, a second scan line, a third scan line, a fourth scan line, an emission control line, and a data line; an emission driver which supplies an emission control signal to the emission control line; a scan driver which supplies first to fourth scan signals to the first to fourth scan lines, respectively, in a period in which the emission control signal is supplied; a data driver which supplies a data signal to the data line; a power supply which supplies, to the pixel, a voltage of a driving power source, a voltage of a first power source, a voltage of a second power source, and a voltage of a third power source; and a timing controller which controls driving of the scan driver, the emission driver, the data driver, and the power supply, where the first scan signal controls a timing at which the voltage of the first power source is supplied to the first node or the second node, and where the power supply changes a level of the voltage of the first power source in one frame period.

The pixel may further include: a light emitting element; a second transistor connected between the data line and the first node and which is turned on in response to the fourth scan signal; a third transistor connected between the second node and a third node and which is turned on in response to the second scan signal, where the third node corresponds to a gate electrode of the first transistor; a fourth transistor which is turned on in response to the first scan signal to apply the voltage of the first power source to the first transistor; a fifth transistor connected between the driving power source and the first node and which is turned off in response to the emission control signal; a sixth transistor connected between the second node and a first electrode of the light emitting element and which is turned off in response to the emission control signal; and a seventh transistor connected between the third node and the second power source and which is turned on in response to the third scan signal.

The one frame period may include a display scan period and at least one bias scan period. In the display scan period, the scan driver may supply the first scan signal through the first scan line, and supply the fourth scan signal through the fourth scan line. In the at least one bias scan period, the scan driver may supply the first scan signal through the first scan line, and may not supply the fourth scan signal.

The power supply may supply the voltage of the first power source having a first voltage level in the display scan period, and supply the voltage of the first power source having a second voltage level different from the first voltage level in the at least one bias scan period.

The at least one bias scan period may include a firs bias scan period and a second bias scan period after the first bias scan period. The power supply may supply the voltage of the first power source having a first voltage level in the display scan period, supply the voltage of the first power source having a second voltage level different from the first voltage level in the first bias scan period, and supply the voltage of the first power source having a third voltage level different from each of the first voltage level and the second voltage level in the second bias scan period.

The data driver may supply the data signal having a fourth voltage level to the data line in the display scan period, and supply the data signal having a fifth voltage level different from the fourth voltage level to the data line in the at least one bias scan period.

The data driver may supply the data signal having a fourth voltage level to the data line in the display scan period, supply the data signal having a fifth voltage level different from the fourth voltage level to the data line in the first bias scan period, and supply the data signal having a sixth voltage level different from each of the fourth voltage level and the fifth voltage level to the data line in the second bias scan period.

The pixel may further include an eighth transistor connected between the first electrode of the light emitting element and the third power source and which is turned on in response to the first scan signal. The power supply may supply the voltage of the third power source having a seventh voltage level in the display scan period, and supply the voltage of the third power source having an eighth voltage level different from the seventh voltage level in the at least one bias scan period.

The pixel may further include an eighth transistor connected between the first electrode of the light emitting element and the third power source and which is turned on in response to the first scan signal. The power supply may supply the voltage of the third power source having a seventh voltage level in the display scan period, supply the voltage of the third power source having an eighth voltage level different from the seventh voltage level in the first bias scan period, and supply the voltage of the third power source having a ninth voltage level different from each of the seventh voltage level and the eighth voltage level in the second bias scan period.

The emission driver may supply the emission control signal in each of a first non-emission period of the display scan period and a second non-emission period of the at least one bias scan period. The scan driver may supply the second scan signal through the second scan line and supplies the third scan signal through the third scan line in the first non-emission period, and may not supply the second scan signal and the third scan signal in the second non-emission period.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
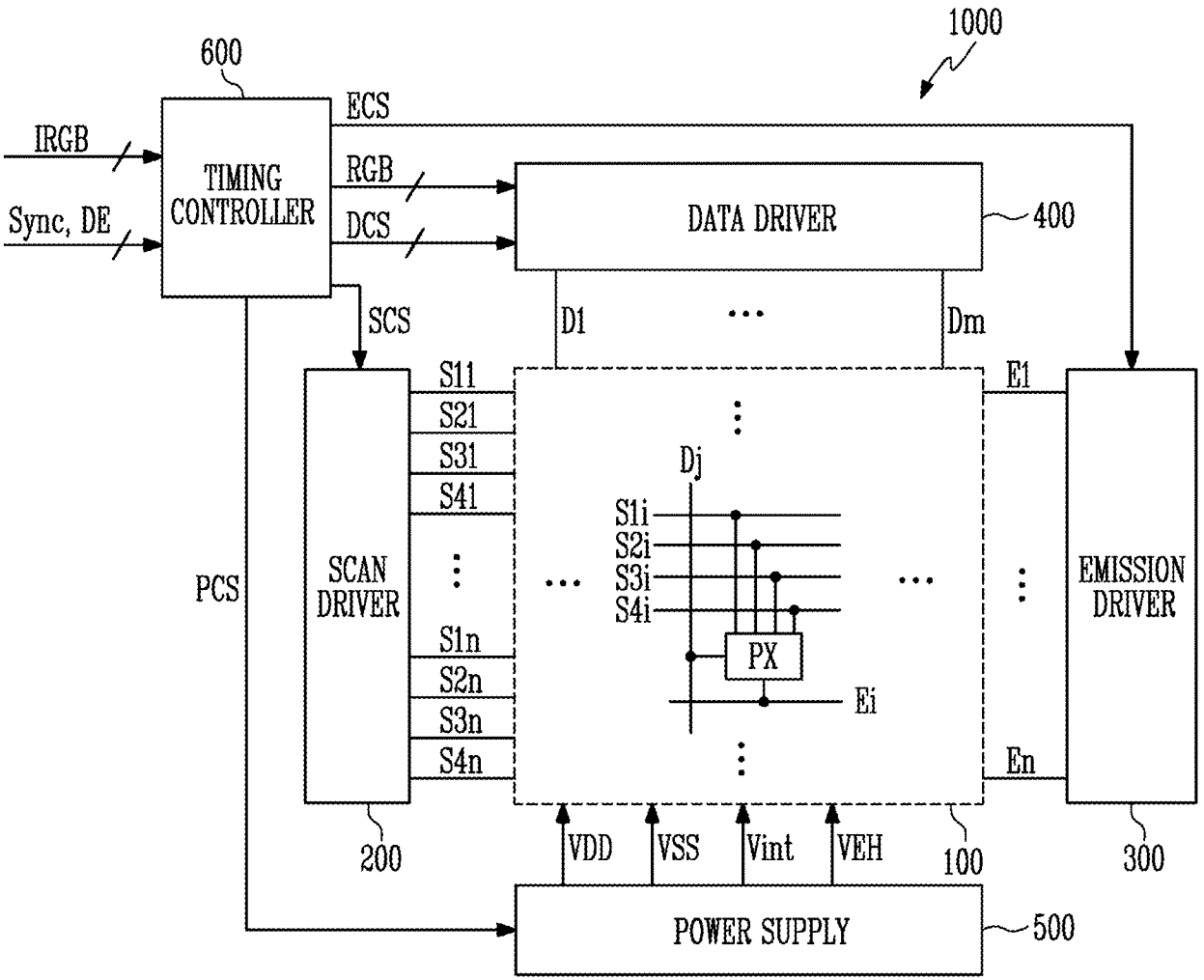
FIG. 1 is a block diagram illustrating a display device in accordance with embodiments of the present disclosure.

The present disclosure may apply various changes and different shape, therefore only illustrate in details with particular examples. However, the examples do not limit to certain shapes but apply to all the change and equivalent material and replacement. The drawings included are illustrated a fashion where the figures are expanded for the better understanding.

Like numbers refer to like elements throughout. In the drawings, the thickness of certain lines, layers, components, elements or features may be exaggerated for clarity. It will be understood that, although the terms "first", "second", etc. may be used herein to describe various elements, these elements should not be limited by these terms. These terms are only used to distinguish one element from another element. Thus, a "first" element discussed below could also be termed a "second" element without departing from the teachings of the present disclosure. As used herein, the singular forms are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence and/or addition of one or more other features, integers, steps, operations, elements, components, and/or groups thereof.

In the entire specification, when an element is referred to as being "connected" or "coupled" to another element, it can be directly connected or coupled to the another element or be indirectly connected or coupled to the another element with one or more intervening elements interposed therebetween.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or to components, but do not preclude the presence or addition of one or more other features, regions, integers, steps, operations, elements, components, and/or groups thereof. Hereinafter, exemplary embodiments of the present disclosure will be described in detail with reference to the accompanying drawings.

FIG. 1 is a block diagram illustrating a display device in accordance with embodiments of the present disclosure.

Referring to FIG. 1, the display device 1000 may include a pixel unit 100, a scan driver 200, an emission driver 300, a data driver 400, a power supply 500, and a timing controller 600.

The display device 1000 may display an image at various frame frequencies (e.g., refresh rates, driving frequencies, or screen refresh rates) according to driving conditions. The frame frequency is a frequency at which a data voltage is substantially written (or applied) to a driving transistor of a pixel PX for one second. For example, the frame frequency is also referred to as a screen scan rate or a screen refresh frequency, and represents a frequency at which a display screen is reproduced for one second.

In an embodiment, an output frequency of the data driver 400 and/or an output frequency of a fourth scan signal supplied to a fourth scan line S4*i* may be changed according to a frame frequency. For example, a frame frequency for moving image may be a frequency of about 60 Hertz (Hz) or more (e.g., 120 Hz). The fourth scan signal of 60 times per second may be supplied to each horizontal line (i.e., pixel row).

In an embodiment, the display device 1000 may adjust an output frequency of the scan driver 200 and the emission driver 300 and an output frequency of the data driver 400 which corresponds to the output frequency of the scan driver 200 and the emission driver 300. For example, the display device 1000 may display an image, corresponding to various frame frequencies of 1 Hz to 120 Hz. However, this is merely illustrative, and the display device 1000 may display image at a frame frequency of 120 Hz or more (e.g., 240 Hz or 480 Hz) in another embodiment.

The display device 1000 may operate at various frame frequencies. In the case of low frequency driving, an image failure such as a flicker may be viewed due to current leakage in the pixel PX. In addition, an afterimage such as image retention may be viewed according to "a change in bias state of the driving transistor, which is caused by driving at various frame frequencies", and "a change in response speed due to a threshold voltage shift, etc. depending on a change in hysteresis characteristic".

In order to improve image quality, one frame period of the pixel PX may include one display scan period and at least one bias scan period, according to a frame frequency. An operation in the display scan period and the bias scan period will be described in detail with reference to FIGS. 4 and 5.

The pixel unit 100 may include scan lines S11 to S1*n*, S21 to S2*n*, S31 to S3*n*, and S41 to S4*n*, emission control lines E1 to En, and data lines D1 to Dm, and include pixels PX connected to the scan lines S11 to Sin, S21 to S2*n*, S31 to S3*n*, and S41 to S4*n*, the emission control lines E1 to En, and the data lines D1 to Dm (m and n are integers greater than 1). Each of the pixels PX may include a driving transistor and a plurality of switching transistors. The pixels PX may be supplied with voltages of a first driving power source VDD, a second driving power source VSS, a first power source VEH, and an initialization power source Vint from the power supply 500.

In an embodiment of the present disclosure, the signal lines connected to the pixel PX may be variously set according to a circuit structure of the pixel PX.

The timing controller 600 may be supplied with input image data IRGB and control signals Sync and DE from a host system such as an Application Processor ("AP") through a predetermined interface.

The timing controller 600 may generate a first control signal SCS, a second control signal ECS, a third control signal DCS, and a fourth control signal PCS, based on input image data IRGB, a synchronization signal Sync (e.g., a vertical synchronization signal, a horizontal synchronization signal, etc.), a data enable signal DE, a clock signal, and the like. The first control signal SCS may be supplied to the scan driver 200, the second control signal ECS may be supplied to the emission driver 300, the third control signal DCS may be supplied to the data driver 400, and the fourth control signal PCS may be supplied to the power supply 500. The timing controller 600 may rearrange input image data IRGB and supply the rearranged image data RGB to the data driver 400.

The scan driver 200 may receive the first control signal SCS from the timing controller 600, and supply a first scan signal, a second scan signal, a third scan signal, and a fourth scan signal to first scan lines S11 to S1*n*, second scan lines S21 to S2*n*, third scan lines S31 to S3*n*, and fourth scan lines S41 to S4*n*, respectively, based on the first control signal SCS.

The first to fourth scan signals may be set to a gate-on voltage (e.g., a low voltage) corresponding to a type of transistors to which the corresponding scan signals are supplied. A transistor receiving a scan signal may be set to a turn-on state when the scan signal is supplied. For example, the gate-on voltage of a scan signal supplied to a P-channel metal oxide semiconductor ("PMOS") transistor may have a logic low level, and the gate-on voltage of a scan signal supplied to an N-channel metal oxide semiconductor ("NMOS") transistor may have a logic high level. Hereinafter, it will be understood that the term "a scan signal is supplied" means that the scan signal is supplied with a logic level at which a transistor controlled by the scan signal is turned on.

The emission driver 300 may supply an emission control signal to the emission control lines E1 to En, based on the second control signal ECS. For example, the emission control signal may be sequentially supplied to the emission control lines E1 to En.

The emission control signal may be set to a gate-off voltage (e.g., a high voltage). A transistor receiving the emission control signal may be turned off when the emission control signal is supplied, and be set to the turn-on state in other cases. Hereinafter, it will be understood that the term "the emission control signal is supplied" means that the emission control signal is supplied with a logic level at which a transistor controlled by the emission control signal is turned off.

For convenience of description, a case where each of the scan driver 200 and the emission driver 300 is a single component has been illustrated in FIG. 1, but the present disclosure according to the invention is not limited thereto. The scan driver 200 may include a plurality of scan drivers which supply at least one of the first to fourth signals, respectively, in another embodiment. In addition, at least portions of the scan driver 200 and the emission driver 300 may be integrated as one driving circuit, one module, or the like.

The data driver 400 may receive the third control signal DCS and image data RGB from the timing controller 600. The data driver 400 may convert the image data RGB in a digital form into an analog data signal (i.e., data voltage). The data driver 400 may supply a data signal to the data lines D1 to Dm, according to the third control signal DCS. The data signal supplied to the data lines D1 to Dm may be supplied to be synchronized with the fourth scan signal supplied to the fourth scan lines S41 to S4*n*.

The power supply 500 may supply, to the pixel unit 100, a voltage of the first driving power source VDD for driving the pixel PX and a voltage of the second driving power source VSS. A voltage level of the second driving power source VSS may be lower than that of the first driving power source VDD. For example, the voltage of the first driving power source VDD may be a positive voltage, and the voltage of the second driving power source VSS may be a negative voltage.

Figure 3:
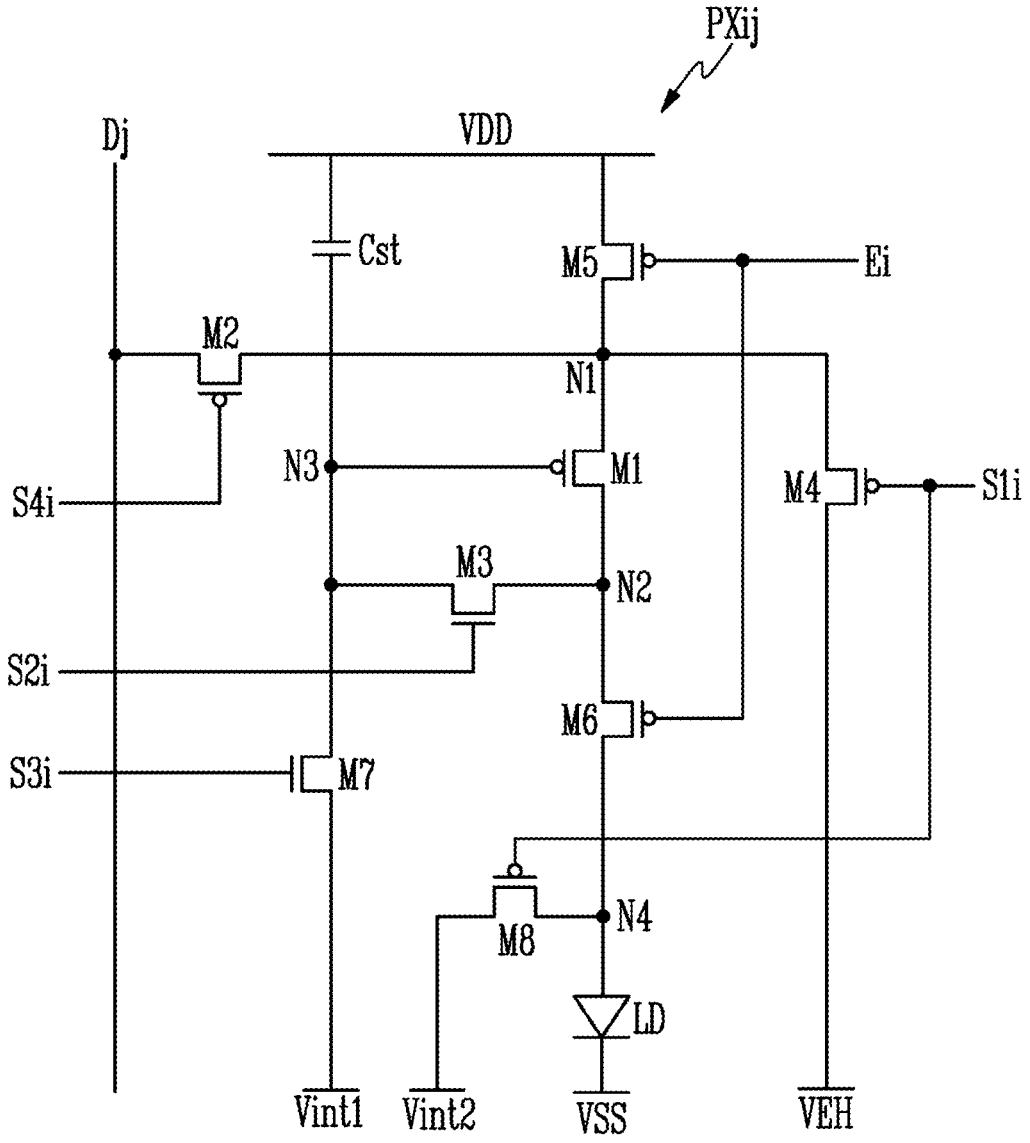
FIG. 3 is a circuit diagram illustrating an example of a pixel included in the display device shown in FIG. 1.

The power supply 500 may supply, to the pixel unit 100, a voltage of the first power source VEH (or bias power source) and a voltage of the initialization power source Vint. The initialization power source Vint may include initialization power sources (e.g., Vint1 and Vint2, which are shown in FIG. 3) which output voltages with different voltage levels.

The first power source VEH may be a power source for supplying a predetermined bias voltage to a source electrode and/or a drain electrode of the driving transistor included in the pixel PX. The first power source VEH may have a positive voltage. However, the voltage level of the first power source VEH according to the invention is not limited thereto. The voltage level of the first power source VEH may correspond to a negative voltage in another embodiment.

The initialization power source Vint may be a power source for initializing the pixel PX. For example, the driving transistor and/or a light emitting element, included in the pixel PX, may be initialized by the voltage of the initialization power source Vint. The voltage of the initialization power source Vint may be a negative voltage.

In an embodiment, the power supply 500 may change a voltage level of at least one of the voltage of the first power source VEH and the voltage of the initialization power source Vint in one frame period, and supply the changed voltage level to the pixel unit 100. Accordingly, a bias state of the driving transistor included in the pixel PX can be controlled.

Figure 2:
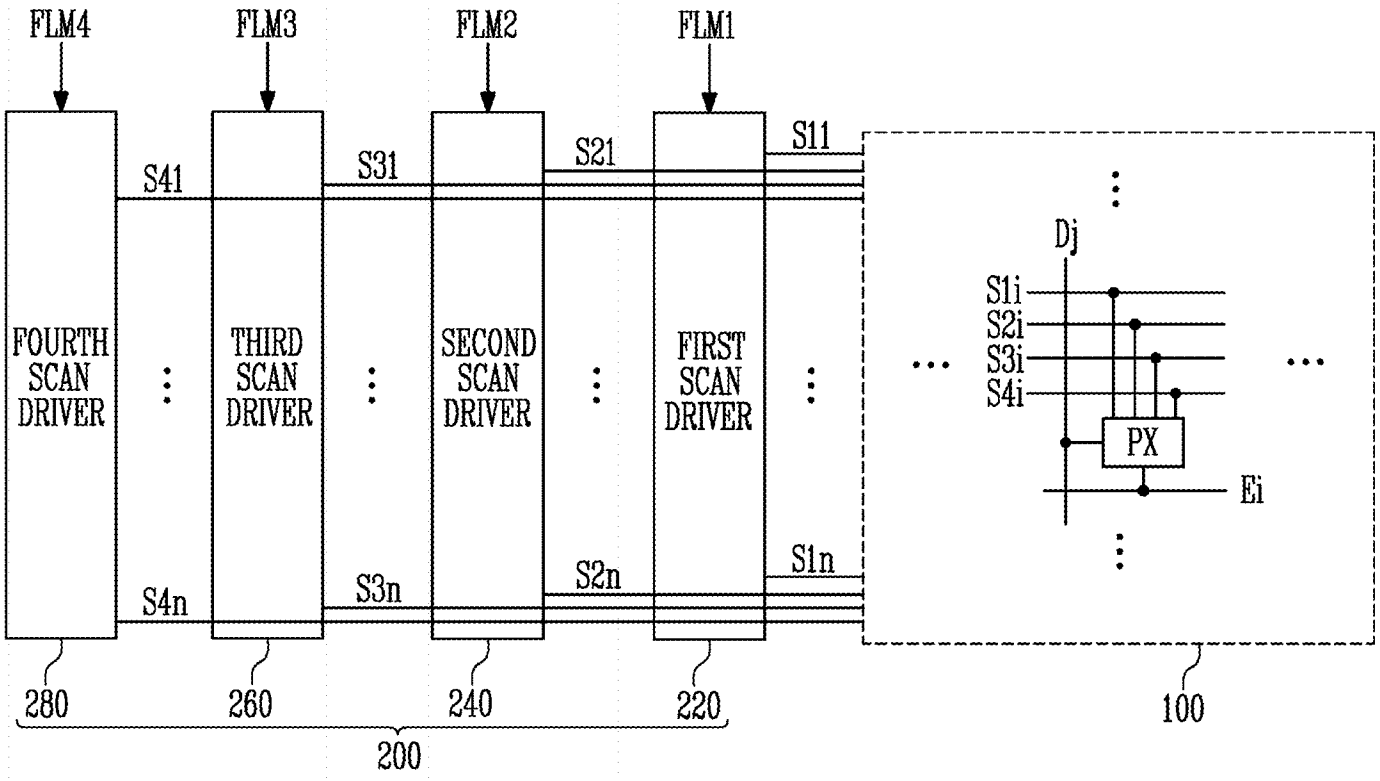
FIG. 2 is a diagram illustrating an example of a scan driver included in the display device shown in FIG. 1.

FIG. 2 is a diagram illustrating an example of the scan driver included in the display device shown in FIG. 1.

Referring to FIGS. 1 and 2, the scan driver 200 may include a first scan driver 220, a second scan driver 240, a third scan driver 260, and a fourth scan driver 280.

The first control signal SCS may include first to fourth scan start signals FLM1 to FLM4. The first to fourth scan start signals FLM1 to FLM4 may be supplied to the first to fourth scan drivers 220, 240, 260, and 280, respectively.

A width (length of time), a supply timing, etc. of the first to fourth scan start signals FLM1 to FLM4 may be determined according to a driving condition of the pixel PX and a frame frequency. The first to fourth scan signals may be output based on the first to fourth scan start signals FLM1 to FLM4, respectively. For example, a signal width (i.e., length of the time when the signal is on) of at least one of the first to fourth scan signals may be different from that of the others of the first to fourth scan signals.

The first scan driver 220 may sequentially supply the first scan signal to the first scan lines S11 to Sin in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3. The fourth scan driver 280 may sequentially supply the fourth scan signal to the fourth scan lines S41 to S4*n* in response to the fourth scan start signal FLM4.

FIG. 3 is a circuit diagram illustrating an example of the pixel included in the display device shown in FIG. 1.

For convenience of description, a pixel PXij which is located on an i-th horizontal line (or i-th pixel row) and is connected to a j-th data line DLj will be illustrated in FIG. 3 (i and j are natural numbers). The pixel PXij shown in FIG. 3 may be substantially identical to the pixel PX shown in FIG. 1.

Referring to FIGS. 1 and 3, the pixel PXij may include a light emitting element LD, first to eighth transistors M1 to M8, and a storage capacitor Cst.

A first electrode (i.e., anode electrode or cathode electrode) of the light emitting element LD may be connected to the sixth transistor M6 (i.e., a fourth node N4), and a second electrode (i.e., cathode electrode or anode electrode) of the light emitting element LD may be connected to the second driving power source VSS. The light emitting element LD may generate light with a predetermined luminance corresponding to an amount of current (i.e., driving current) supplied from the first transistor M1.

In an embodiment, the light emitting element LD may be an organic light emitting diode including an organic emitting layer. In another embodiment, the light emitting element LD may be an inorganic light emitting element formed of an inorganic material. In another embodiment, the light emitting element LD may be a light emitting element made of a combination of an organic material and an inorganic material. Alternatively, the light emitting element LD may have a form in which a plurality of inorganic light emitting to elements are connected in parallel and/or series between the second driving power source VSS and the sixth transistor M6.

A first electrode of the first transistor M1 (i.e., a driving transistor) may be connected to a first node N1, and a second electrode of the first transistor M1 may be connected to a second node N2. The first transistor M1 may control an amount of current flowing from the first driving power source VDD to the second driving power source VSS via the light emitting element LD, corresponding to a voltage of a third node N3. To this end, the first driving power source VDD may be set to a voltage higher than that of the second driving power source VSS.

The second transistor M2 may be connected between the j-th data line Dj (hereinafter, referred to as a data line) and the first node N1. A gate electrode of the second transistor M2 may be connected to an i-th fourth scan line S4*i* (hereinafter, referred to as a fourth scan line). The second transistor M2 may be turned on when the fourth scan signal is supplied from the fourth scan line S4*i*, to electrically connect the data line Dj and the first node N1.

The third transistor M3 may be connected between the second electrode (i.e., the second node N2) and a gate electrode (i.e., the third node N3) of the first transistor M1. A gate electrode of the third transistor M3 may be connected to an i-th second scan line S2*i* (hereinafter, referred to as a second scan line). The third transistor M3 may be turned on when the second scan signal is supplied from the second scan line S2*i*, to electrically connect the second electrode and the gate electrode (i.e., the second node N2 and the third node N3) of the first transistor M1. That is, a timing at which the second electrode (e.g., a drain electrode) of the first transistor M1 and the gate electrode of the first transistor M1 are connected to each other may be controlled by the second scan signal. When the third transistor M3 is turned on, the first transistor M1 may be connected in a diode form.

The fourth transistor M4 may be turned on in response to an i-th first scan signal supplied from an i-th first scan line S1*i* (hereinafter, referred to as a first scan line), to supply a voltage of the first power source VEH to the first transistor M1. In an embodiment, the fourth transistor M4 may be connected between the first node N1 (i.e., the first electrode of the first transistor M1) and the first power source VEH. A timing at which the voltage of the first power source VEH is supplied to the first node N1 may be controlled by the first scan signal.

A gate electrode of the fourth transistor M4 may be connected to the first scan line S1*i*. When the fourth transistor M4 is turned on, the voltage of the first power source VEH may be supplied to the first node N1. In an embodiment, the voltage of the first power source VEH may be similar to that of a data voltage of a black grayscale. For example, the voltage of the first power source VEH may be about 5 to 7 voltages (V).

When the fourth transistor M4 is turned on, a predetermined high voltage may be applied to the first electrode (e.g., a source electrode) of the first transistor M1. When the third transistor M3 is in a turn-off state, the first transistor M1 may have an on-bias state (a state in which the first transistor M1 can be turned on) (i.e., is on-biased).

In an embodiment, a voltage level of the first power source VEH may be changed in one frame period. For example, the first power source VEH may have a first voltage level in a display scan period during the one frame period, and have a second voltage level in a bias scan period during the same frame period. That is, the first power source VEH may have different voltage levels in the display scan period and the bias scan period. The second voltage level may be higher than the first voltage level. In another example, when one frame period includes one display scan period and a plurality of bias scan periods, the first power source VEH may have the first voltage level in the one display scan period, have the second voltage level in a first bias scan period among the bias scan periods, and have a third voltage level in a second bias scan period among the bias scan periods (See FIG. 6B). That is, the first power source VEH may not only have different voltage levels in the display scan period and the bias scan period, but also have different voltage levels in the first bias scan period and the second bias scan period among the bias scan periods. The third voltage level may be higher than the second voltage level. Accordingly, in low frequency driving in which the length of one frame period is lengthened, the voltage level of the first power source VEH which applies an on-bias voltage to the first electrode (e.g., the source electrode) of the first transistor M1 is changed, so that display quality deterioration due to a change in hysteresis characteristic of the first transistor M1 can be further minimized.

The fifth transistor M5 may be connected between the first driving power source VDD and the first node N1. A gate electrode of the fifth transistor M5 may be connected to an i-th emission control line Ei (hereinafter, referred to as an emission control line Ei). The fifth transistor M5 may be turned off when the emission control signal is supplied to the emission control signal Ei, and be turned on in other cases.

The sixth transistor M6 may be connected between the second electrode (i.e., the second node N2) of the first transistor M1 and the first electrode (i.e., the fourth node N4) of the light emitting element LD. A gate electrode of the sixth transistor M6 may be connected to the emission control line Ei. The sixth transistor M6 may be controlled substantially identical to the fifth transistor M5.

Although a case where the fifth transistor M5 and the sixth transistor M6 are connected to the same emission control line Ei is illustrated in FIG. 3, this is merely illustrative, and the fifth transistor M5 and the sixth transistor M6 may be connected to separate emission control lines, respectively, to which different emission control signals are supplied in another embodiment.

The seventh transistor M7 may be connected between the third node N3 and a first initialization power source Vint1 (in other words, a second power source). A gate electrode of the seventh transistor M7 may be connected to an i-th third scan line S3*i* (hereinafter, referred to as a third scan line). The seventh transistor M7 may be turned on when the third scan signal is supplied from the third scan line S3*i*, to supply the voltage of the first initialization power source Vint1 to the third node N3. The voltage of the first initialization power source Vint1 may be set as a voltage lower than that of a data signal supplied to the data line Dj.

Accordingly, a gate voltage of the first transistor M1 may be initialized to the voltage of the first initialization power source Vint1 when the seventh transistor M7 is turned on.

The eighth transistor M8 may be connected between the first electrode (i.e., the fourth node N4) of the light emitting element LD and a second initialization power source Vint2 (in other words, a third power source). In an embodiment, a gate electrode of the eighth transistor M8 may be connected to the first scan line S1*i*. The eighth transistor M8 may be turned on when the first scan signal is supplied from the first scan line S1*i*, to supply a voltage of the second initialization power source Vint2 to the first electrode of the light emitting element LD (i.e., the fourth node N4).

When the voltage of the second initialization power source Vint2 is supplied to the first electrode of the light emitting element LD, a parasitic capacitor of the light emitting element LD may be discharged. Since a residual voltage charged in the parasitic capacitor is discharged (i.e., eliminated), unintended fine emission can be effectively prevented. Thus, a black expression capability of the pixel PXij can be improved.

In an embodiment, a voltage level of the second initialization power source Vint2 may be changed in one frame period. For example, the second initialization power source Vint2 may have a seventh voltage level in a display scan period during the one frame period, and have an eighth voltage level in a bias scan period during the one frame period. That is, the second initialization power source Vint2 may have different voltage levels in the display scan period and the bias scan period (See FIG. 9A). The eighth voltage level may be lower than the seventh voltage level. In another example, when one frame period includes one display scan period and a plurality of bias scan periods, the second initialization power source Vint2 may have the seventh voltage level in the one display scan period, have the eighth voltage level in a first bias scan period among the bias scan periods, and have a ninth voltage level in a second bias scan period among the bias scan periods. That is, the second initialization power source Vint2 may not only have different voltage levels in the display scan period and the bias scan period, but also have different voltage levels in the first bias scan period and the second bias scan period among the bias scan periods (See FIG. 9B). The ninth voltage level may be lower than the eighth voltage level. Accordingly, in the low frequency driving in which the length of one frame period is lengthened, the voltage level of the second initialization power source Vint2 applied to the first electrode (e.g., the anode electrode) of the light emitting element LD is changed, so that an initialization amount of the parasitic capacitor of the light emitting element LD is changed. Thus, luminance fluctuation due to a change in hysteresis characteristic of the first transistor M1 can be effectively prevented, and accordingly, display quality deterioration can be further minimized.

The first initialization power source Vint1 and the second initialization power source Vint2 may have different voltages. That is, a voltage for initializing the third node N3 and a voltage for initializing the fourth node N4 may be set different from each other.

In the low frequency driving in which the length of one frame period is lengthened, when the voltage of the first initialization power source Vint1 supplied to the third node N3 is excessively low, a strong on-bias is applied to the first transistor M1, and hence a threshold voltage of the first transistor M1 in a corresponding frame period is shifted. Such a hysteresis characteristic may cause a flicker phenomenon in the low frequency driving. Therefore, in the display device driven at a low frequency, the voltage of the first initialization power source Vint1, which is higher than that of the second driving power source VSS, may be desirable.

However, when the voltage of the second initialization power source Vint2 supplied to the fourth node N4 is higher than a predetermined reference value, the voltage of the parasitic capacitor of the light emitting element LD is not discharged but may be charged. Therefore, it is desirable that the voltage of the second initialization power source Vint2 is to be sufficiently low enough to discharge the voltage of the parasitic capacitor of the light emitting element LD. For example, by considering a threshold voltage of the light emitting element LD, the voltage of the second initialization power source Vint2 may be set to be lower than a value obtained by adding up the threshold voltage of the light emitting element LD and the voltage of the second driving power source VSS.

However, this is merely illustrative, and the voltage of the first initialization power source Vint1 and the voltage of the second initialization power source Vint2 may be variously set. In an example, the voltage of the first initialization power source Vint1 and the voltage of the second initialization power source Vint2 may be substantially the same.

The storage capacitor Cst may be connected between the first driving power source VDD and the third node N3. The storage capacitor Cst may store a voltage applied to the third node N3.

A voltage level of the data signal supplied to the data line Dj may be changed according to the voltage level of the first power source VEH, which is changed in one frame period. A phenomenon in which the voltage level of a voltage applied to the gate electrode (i.e., the third node N3) of the first transistor M1 (i.e., a voltage stored in the storage capacitor Cst) is changed can be prevented, even when the voltage level of the first power source VEH is changed by coupling of a parasitic capacitor between the second transistor M2 and the first transistor M1. Accordingly, even in the low frequency driving in which the length of one frame period is lengthened, the voltage stored in the storage capacitor Cst is constantly maintained during the one frame period, so that the pixel PXij during the one frame period can constantly emit light with a luminance corresponding to a data signal of the corresponding frame period.

In addition, the voltage level of the data signal supplied to the data line Dj may be changed based on the voltage level of the second initialization power source Vint2, which is changed in one frame period. A phenomenon in which the voltage level of the voltage applied to the gate electrode (i.e., the third node N3) of the first transistor M1 (i.e., the voltage stored in the storage capacitor Cst) is changed can be prevented, even when the voltage level of the second initialization power source Vint2 is changed by the coupling of the parasitic capacitor between the second transistor M2 and the first transistor M1. Accordingly, even in the low frequency driving in which the length of one frame period is lengthened, the voltage stored in the storage capacitor Cst is constantly maintained during the one frame period, so that the pixel PXij during the one frame period can constantly emit light with a luminance corresponding to a data signal of the corresponding frame period.

In an embodiment, the first transistor M1, the second transistor M2, the fourth transistor M4, the fifth transistor M5, the sixth transistor M6, and the eighth transistor M8 may be implemented with a poly-silicon semiconductor transistor. For example, the first transistor M1, the second transistor M2, the fourth transistor M4, the fifth transistor M5, the sixth transistor M6, and the eighth transistor M8 may include, as an active layer (i.e., channel), a poly-silicon semiconductor layer formed through a low temperature poly-silicon ("LTPS") process. Also, the first transistor M1, the second transistor M2, the fourth transistor M4, the fifth transistor M5, the sixth transistor M6, and the eighth transistor M8 may be implemented with a P-type transistor (e.g., a PMOS transistor). Accordingly, a gate-on voltage at which the first transistor M1, the second transistor M2, the fourth transistor M4, the fifth transistor M5, the sixth transistor M6, and the eighth transistor M8 are turned on may have a logic low level.

Since the poly-silicon semiconductor transistor has a fast response speed, the poly-silicon semiconductor transistor may be applied to a switching element which requires fast switching.

In an embodiment, the third transistor M3 and the seventh transistor M7 may be implemented with an oxide semiconductor transistor. For example, the third transistor M3 and the seventh transistor M7 may be implemented with an N-type oxide semiconductor transistor (e.g., an NMOS transistor), and include an oxide semiconductor layer as an active layer. Accordingly, a gate-on voltage at which the third transistor M3 and the seventh transistor M7 are turned on may have a logic high level.

The oxide semiconductor transistor can be formed through a low temperature process, and have a charge mobility lower than a charge mobility of a poly-silicon semiconductor transistor. That is, the oxide semiconductor transistor has an excellent off-current characteristic. Thus, when the third transistor M3 and the seventh transistor M7 are implemented with the oxide semiconductor transistor, leakage current from the second node N2 according to the low frequency driving can be minimized, and accordingly, display quality can be improved.

However, the first to eighth transistors M1 to M8 according to the invention are not limited thereto. At least one of the first transistor M1, the second transistor M2, the fourth transistor M4, the fifth transistor M5, the sixth transistor M6, and the eighth transistor M8 may be implemented with the oxide semiconductor transistor, or at least one of the third transistor M3 and the seventh transistor M7 may be implemented with the poly-silicon semiconductor transistor in another embodiment.

Figure 4:
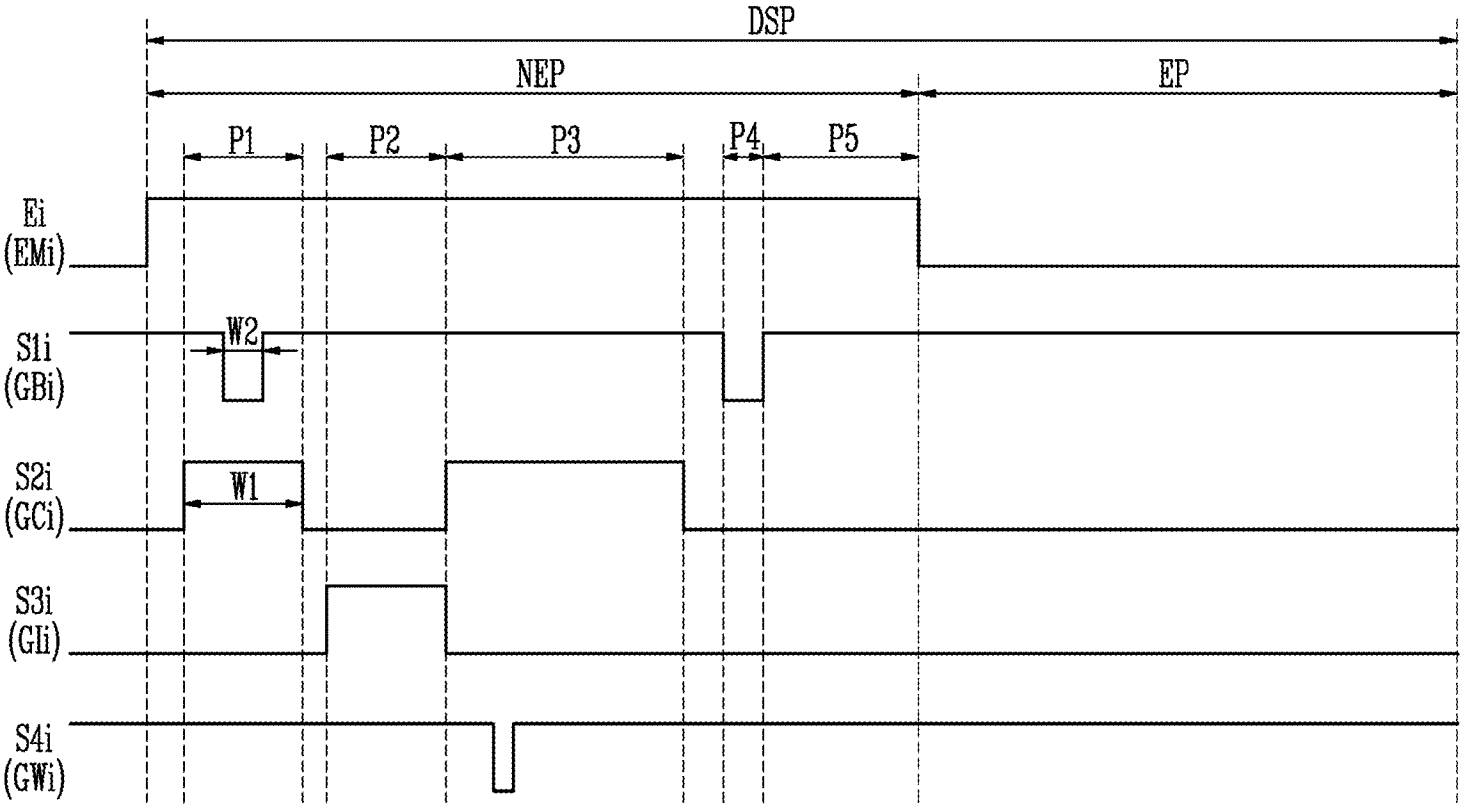
FIG. 4 is a timing diagram illustrating an example of signals supplied to the pixel shown in FIG. 3.
Figure 5:
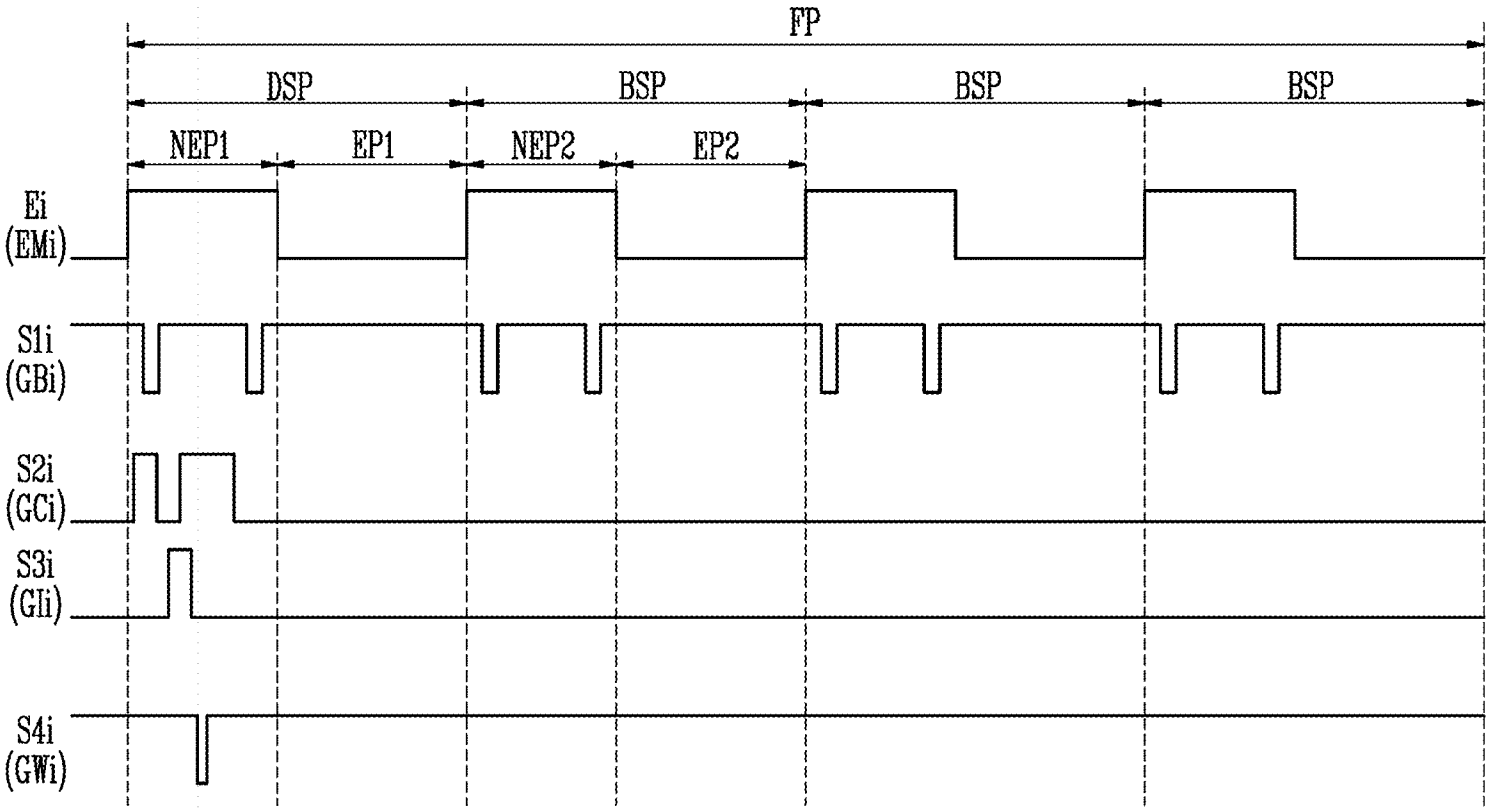
FIG. 5 is a timing diagram illustrating an example of the signals supplied to the pixel shown in FIG. 3 during one frame period.

FIG. 4 is a timing diagram illustrating an example of signals supplied to the pixel shown in FIG. 3. FIG. 5 is a timing diagram illustrating an example of the signals supplied to the pixel shown in FIG. 3 during one frame period.

Referring to FIGS. 3 to 5, in variable frequency driving in which a frame frequency (i.e., frequency of the frame period FP) is controlled, one frame period FP may include a display scan period DSP and at least one bias scan period BSP.

The display scan period DSP may include a first non-emission period NEP1 and a first emission period EP1. The bias scan period BSP may include a second non-emission period NEP2 and a second emission period EP2. A non-emission period NEP and an emission period EP, which are shown in FIG. 4, may correspond to the first non-emission period NEP1 and the first emission period EP1, respectively, which are shown in FIG. 5.

The display scan period DSP may include a period in which a data signal actually corresponding to an output image is written (i.e., applied) to the pixel PX. For example, when a still image is displayed in low frequency driving, a data signal may be written to the pixel PX for each display scan period DSP.

As shown in FIG. 5, an emission control signal EMi may be supplied to the emission control line Ei at a first frequency higher than the frame frequency. A third scan signal GIi provided through the third scan line S3*i* and a fourth scan signal GWi provided through the third scan line S4*i* may be supplied at a second frequency lower than the first frequency. For example, the first frequency may be 240 Hz, and the second frequency may be 60 Hz. The frequency of the third scan signal GIi and a fourth scan signal GWi may be substantially equal to the frame frequency.

However, this is merely illustrative, and the second frequency may be 60 Hz or lower in another embodiment. As the second frequency becomes lower or as a difference between the first frequency and the second frequency becomes larger, the number of times the bias scan period BSP is repeated in the frame period FP (i.e., the number of bias scan periods) may increase. For example, the frame period FP may include one display scan period DSP and a plurality of consecutive bias scan periods BSP.

In an embodiment, a second scan signal GCi provided through the third scan line S2*i* may be supplied in only the first non-emission period NEP1. The second scan signal GCi may be supplied plural times to the second scan line S2*i* in the first non-emission period NEP1.

In an embodiment, a first scan signal GBi provided through the third scan line S1*i* may be supplied in the first non-emission period NEP1 and the second non-emission period NEP2. The first scan signal GBi may be supplied plural times to the first scan line S1*i* in the first non-emission period NEP1. Also, the first scan signal GBi may be supplied plural times from the first scan line S1*i* in the second non-emission period NEP2.

The first scan signal GBi may be a signal for controlling the first transistor M1 to be in an on-bias state. For example, when the fourth transistor M4 is turned on by the first scan signal GBi, the voltage of the first power source VEH may be supplied to the first node N1. Also, the first scan signal GBi may be a signal for initializing the light emitting element LD. For example, when the eighth transistor M8 is turned on by the first scan signal GBi, the voltage of the second initialization power source Vint2 may be supplied to the fourth node N4.

In the display device in accordance with embodiments of the present disclosure, the voltage of the first power source VEH may be periodically applied to the first electrode (i.e., the source electrode) of the first transistor M1 through the fourth transistor M4. When the voltage of the first power source VEH is supplied to the source electrode of the first transistor M1, the first transistor M1 may be in the on-bias state, and a threshold voltage characteristic of the first transistor M1 may be changed. Thus, the first transistor M1 can be effectively prevented from being degraded since a characteristic of the first transistor M1 is fixed to a specific state in the low frequency driving.

In one embodiment, the voltage level of the first power source VEH may be changed in one frame period FP. Accordingly, display quality deterioration due to a change in hysteresis characteristic of the first transistor M1 can be further minimized. An operation of the pixel PXij according to a change in voltage level of the first power source VEH will be described in detail with reference to FIGS. 6A, 6B, and 8A to 11.

In the display device in accordance with embodiments of the present disclosure, the voltage of the second initialization power source Vint2 may be periodically applied to the first electrode (i.e., the anode electrode) of the light emitting element LD through the eighth transistor M8. When the voltage of the second initialization power source Vint2 is supplied to the first electrode of the light emitting element LD, a residual voltage charged in the parasitic capacitor of the light emitting element LD is discharged (i.e., eliminated), unintended fine emission can be effectively prevented.

In an embodiment, the voltage level of the second initialization power source Vint2 may be changed in one frame period FP. Accordingly, display quality deterioration due to the residual voltage charged in the parasitic capacitor of the light emitting element LD can be further minimized. An operation of the pixel PXij according to a change in voltage level of the second initialization power source Vint2 will be described in detail with reference to FIGS. 7A to 11.

Although a case where the first scan signal GBi is supplied in all the non-emission periods NEP1 and NEP2 has been illustrated in FIG. 5, the present disclosure according to the invention is not limited thereto. The first scan signal GBi may be supplied in only some of the second non-emission periods NEP2 in another embodiment. For example, the first scan signal GBi may be supplied from the first scan line S1*i* in only the display scan period DPS and a second bias scan period BSP shown in FIG. 5.

A period in which the emission control signal EMi has a logic low level may correspond to the emission periods EP, EP1, and EP2, and a period except the emission periods EP, EP1, and EP2 may correspond to the non-emission periods NEP, NEP1, and NEP2. The emission control signal EMi has a logic high level in the non-emission periods NEP, NEP1, and NEP2.

Gate-on voltages of the second scan signal GCi and the third scan signal GIi, which are supplied to the third transistor M3 and the seventh transistor M7 as the N-type transistors, respectively, may have a logic high level. Gate-on voltages of the fourth scan signal GWi and the first scan signal GBi, which are supplied to the second transistor M2, the fourth transistor M4, and the eighth transistor M8 as the P-type transistors, respectively, may have a logic low level.

As shown in FIG. 5, the first scan signal GBi may be supplied from the first scan line S1*i* in the second non-emission period NEP2 as a non-emission period of the bias scan period BSP. Therefore, the voltage of the first power source VEH may be supplied to the first electrode of the first transistor M1 in the second non-emission period NEP2. That is, an on-bias may be periodically applied to the first transistor M1, regardless of the frame frequency. In addition, the first scan signal GBi may be supplied plural times through the first scan line S1*i* in the second non-emission period NEP2 so as to maintain a stable on-bias state. Accordingly, a luminance change of the first transistor M1 in the frame period FP of the low frequency driving can be minimized. The first scan signal GBi may be supplied plural times through the first scan line S1*i* even in the display scan period so as to drive the scan driver 200 and to simplify the configuration of the display device 1000.

Hereinafter, the scan signal GBi, GCi, GIi, and GWi supplied in the display scan period DSP and an operation of the pixel PXij will be described in detail with reference to FIGS. 3 and 4.

The emission control signal EMi may be supplied from the emission control line Ei during the non-emission period NEP. Accordingly, the fifth transistor M5 and the sixth transistor M6 may be turned off during the non-emission period NEP. The non-emission period NEP may include first to fifth periods P1 to P5.

In the first period P1, the scan driver 200 may supply the second scan signal GCi to the second scan line S2*i*, and supply the first scan signal GBi to the first scan line S1*i*. In an embodiment, the first scan signal GBi may be supplied after the second scan signal GCi is supplied. Therefore, in the first period P1, the fourth transistor M4 may be turned on after the third transistor M3 is turned on.

When only the fourth transistor M4 is turned on without supplying the second scan signal GCi (without turning on the third transistor M3), the voltage of the first power source VEH may be supplied to the first node N1 (i.e., the source electrode of the first transistor M1). The voltage of the first power source VEH as a high voltage is applied to the first node N1, so that the first transistor M1 may have the on-bias state. For example, when the voltage of the first power source VEH is about 5V or higher, the first transistor M1 has a source voltage and a drain voltage of about 5V or higher, and the absolute value of a gate-source voltage of the first transistor M1 may increase.

When a data signal is supplied by the supply of the fourth scan signal GWi in this state, a driving current may be unintentionally changed due to influence of the bias state of the first transistor M1, and image luminance may be fluctuated (e.g., an increase in luminance).

In order to solve this problem, the scan driver 200 may supply the second scan signal GCi earlier than the first scan signal GBi in the first period P1 in an embodiment of the present invention. Therefore, the third transistor M3 may be turned on earlier than the fourth transistor M4. The second node N2 and the third node N3 may be electrically connected to each other when the third transistor M3 is turned on. Subsequently, when the fourth transistor M4 is turned on, the voltage of the first power source VEH may be transferred up to the third node N3 through the first node N1. In other words, a voltage difference between the first node N1 and the third node N3 may be decreased to the threshold voltage of the first transistor M1. Therefore, the magnitude of the gate-source voltage of the first transistor M1 may be considerably decreased in the first period P1. For example, the first transistor M1 may be set to an off-bias state.

As described above, in order to prevent an unintended luminance increase due to the supply of the voltage of the first power source VEH before the data signal is written to the pixel PX in the first period P1, the supply of the first scan signal GBi and the second scan signal GCi may be controlled such that the fourth transistor M4 is turned on in a state in which the third transistor M3 is turned on.

In an embodiment, a width W1 (i.e., length of time) of the second scan signal GCi may be greater than a width W2 of the first scan signal GBi in the first period P1. For example, in the first period P1, the third transistor M3 may be turned on earlier than the fourth transistor M4, and be turned off after the fourth transistor M4 is turned off.

However, this is merely illustrative, and the third transistor M3 may be turned off earlier than the fourth transistor M4 in another embodiment.

The eighth transistor M8 may be turned on in response to the first scan signal GBi, and the voltage of the second initialization power source Vint2 may be supplied to the first electrode (i.e., the fourth node N4) of the light emitting element LD.

Subsequently, in the second period P2, the scan driver 200 may supply the third scan signal GIi to the third scan line S3*i*. The seventh transistor M7 may be turned on by the third scan signal GIi. When the seventh transistor M7 is turned on, the voltage of the first initialization power source Vint1 may be supplied to the gate electrode of the first transistor M1. That is, in the second period P2, the gate voltage of the first transistor M1 may be initialized based on the voltage of the first initialization power source Vint1. Therefore, a strong on-bias may be applied to the first transistor M1, and the hysteresis characteristic may be changed (i.e., threshold voltage may be shifted).

Subsequently, in the third period P3, the scan driver 200 may supply the second scan signal GCi to the second scan line S2*i*. The third transistor M may be again turned on in response to the second scan signal GCi. In the third period P3, the scan driver 200 may supply the fourth scan signal GWi to the fourth scan line S4*i* in response to a portion of the second scan signal GCi. The second transistor M2 may be turned on by the fourth scan signal GWi, and the data signal may be provided to the first node N1.

The first transistor M1 may be connected in the diode form by the turned-on third transistor M3, and data signal writing and threshold voltage compensation may be performed. Since the supply of the second scan signal GCi is maintained even after the supply of the fourth scan signal GWi is suspended, the threshold voltage of the first transistor M1 may be compensated for a sufficient time.

Subsequently, in the fourth period P4, the scan driver 200 may again supply the first scan signal GBi to the first scan line S1*i*. Therefore, the fourth transistor M4 and the eighth transistor M8 may be turned on. The voltage of the first power source VEH may be supplied to the first node N1 when the fourth transistor M4 is turned on.

Influence of the strong on-bias applied in the second period P2 may be eliminated by a data signal writing operation and a threshold voltage compensation operation. For example, a voltage difference between the gate voltage and the source voltage (or a voltage difference between the gate voltage and the drain voltage) of the first transistor M1 may be considerably decreased by the threshold voltage compensation in the third period P3. Then, the characteristic of the first transistor M1 may be again changed, and a driving current of the emission period EP may increase or excitation of the black grayscale may be viewed.

In order to prevent this characteristic change, the fourth transistor M4 may be turned on in the fourth period P4. Therefore, in the fourth period P4, the voltage of the first power source VEH is supplied to the source electrode of the first transistor M1, so that the first transistor M1 can be set to the on-bias state.

A sufficient spare time is necessary between the fourth period P4 and the emission period EP so as to allow the first transistor M1 to be set to a stable on-bias state before emission by an operation in the fourth period P4. Therefore, the fifth period P5 in which the scan signals GBi, GCi, GIi, and GWi are not supplied may be inserted between the fourth period P4 and the emission period EP.

In an embodiment, the fifth period P5 may correspond to four horizontal periods or more. For example, a length of the fifth period P5 may be about 10 μm or more. Accordingly, the first transistor M1 may have a stable on-bias state before the emission period EP. Thus, emission luminance can be stably maintained even when the frame period FP shown in FIG. 5 is repeated.

In an embodiment, the first to fourth scan signals GBi, GCi, GIi, and GWi may be respectively supplied from the first to fourth scan drivers 220, 240, 260, and 280 shown in FIG. 2.

Figure 6A:
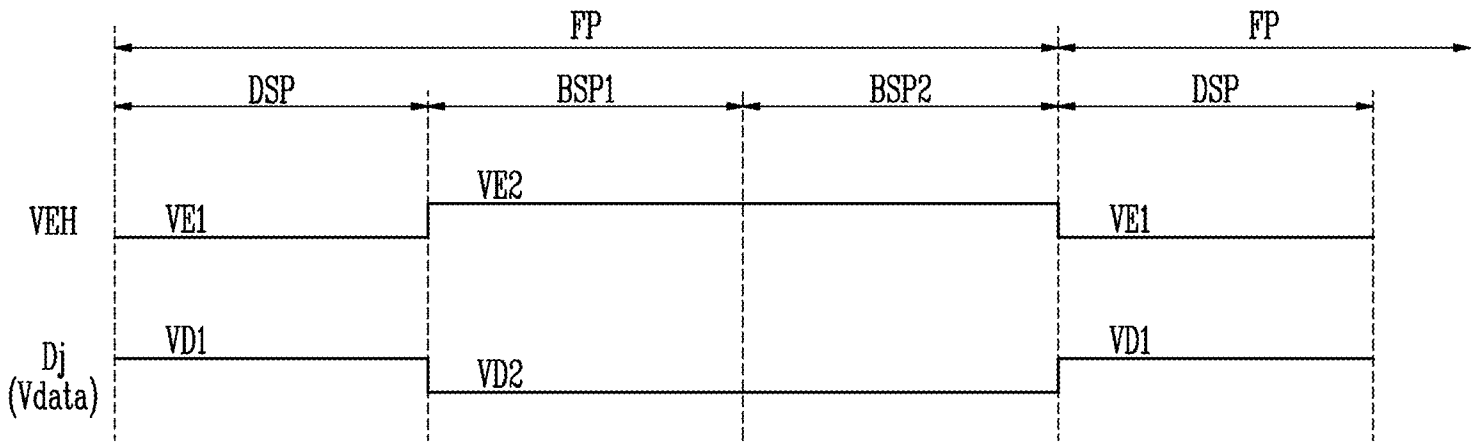
FIGS. 6A and 6B are timing diagrams illustrating examples of a voltage of a first power source and a data signal, which are supplied to the pixel shown in FIG. 3.
Figure 6B:
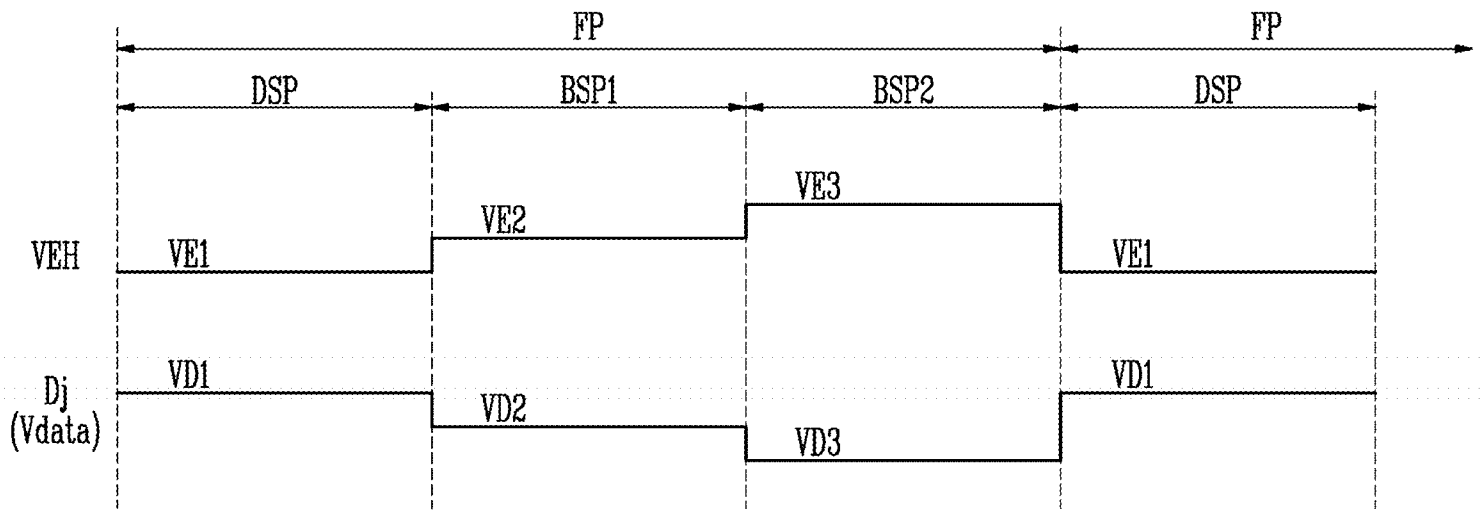

FIGS. 6A and 6B are timing diagrams illustrating examples of the voltage of the first power source and the data signal, which are supplied to the pixel shown in FIG. 3.

Referring to FIGS. 3, 5, and 6A, the voltage level of the first power source VEH may be changed in one frame period FP. For example, the first power source VEH may have a first voltage level VE1 in a display scan period DSP, and have a second voltage level VE2 in at least one bias scan period BSP1 and BSP2. The second voltage level VE2 may be higher than the first voltage level VE1.

In the case of low frequency driving, the length of the one frame period FP is lengthened. In particular, the length of the one frame period FP is further lengthened as a driving frequency becomes lower. A degree to which a driving current is unintentionally changed by influence of a bias state of the first transistor M1 may become more serious. Accordingly, the luminance of a displayed image may be fluctuated (e.g., the luminance increases).

In the display device in accordance with embodiments of the present disclosure, the voltage level of the first power source VEH is changed in the one frame period FP, so that the fluctuation of image luminance due to the influence of the bias state of the first transistor M1 can be more effectively prevented (i.e., eliminated).

Specifically, in the low frequency driving, the degree to which the driving current is changed may become serious as a display period is lengthened in the one frame period FP. That is, a degree to which the driving current is changed in the bias scan periods BSP1 and BSP2 may become more serious than that in the display scan period DSP. Accordingly, although the voltage of the first power source VEH having a voltage level (i.e., the first voltage level VE1) equal to that in the display scan period DSP is supplied to the first node N1 in the bias scan periods BSP1 and BSP2, the fluctuation of image luminance due to the influence of the bias state of the first transistor M1 may still occur.

Accordingly, in the display device in accordance with embodiments of the present disclosure, as shown in FIG. 6A, the first power source VEH having a voltage level (i.e., the second voltage level VE2) higher than that in the display scan period DSP is supplied to the pixel PXij in the at least one bias scan period BSP1 and BSP2, so that fluctuation of image luminance in the bias scan periods BSP1 and BSP2 can be more effectively prevented (i.e., eliminated).

Referring to FIG. 6B, in an embodiment, the voltage level of the first power source VEH may be changed in the bias scan periods BSP1 and BSP2. For example, the first power source VEH may have the second voltage level VE2 in the first bias scan period BSP1, and have a third voltage level VE3 in the second bias scan period BSP2. The third voltage level VE3 may be higher than the second voltage level VE2.

Similar to as described with reference to FIG. 6A, the degree to which the driving current is changed may become serious as the display period is lengthened even in the bias scan periods BSP1 and BSP2. That is, a degree to which the driving current is changed in the second bias scan period BSP2 may become more serious than that in the first bias scan period BSP1. Accordingly, although the voltage of the first power source VEH having a voltage level (i.e., the second voltage level VE2) equal to that in the first bias scan period BSP1 is supplied to the first node N1 in the second bias scan period BSP2, the fluctuation of image luminance due to the influence of the bias state of the first transistor M1 may still occur.

Accordingly, in the display device in accordance with embodiments of the present disclosure, as shown in FIG. 6B, the first power source VEH having a voltage level (i.e., the third voltage level VE3) higher than that in the first bias scan period BSP1 is supplied to the pixel PXij in the second bias scan period BSP2, so that fluctuation of image luminance in the bias scan periods BSP1 and BSP2 (or the second bias scan period BSP2) can be more effectively prevented (i.e., eliminated).

As the voltage level of the first power source VEH is changed, i.e., as the voltage level of the first power source VEH applied to the first node N1 in the bias scan periods BSP1 and BSP2, a voltage applied to the gate electrode (i.e., the third node N3) of the first transistor M1 (i.e., a voltage stored in the storage capacitor Cst) may be fluctuated (e.g., a voltage level of the voltage applied to the third node N3 is changed (e.g., increased) corresponding to a data signal Vdata) by influence of a parasitic capacitor between the first node N1 and the third node N3 (i.e., a parasitic capacitor between the source electrode and the gate electrode of the first transistor M1).

In the display device in accordance with embodiments of the present disclosure, a voltage level of the data signal Vdata supplied from the data line Dj may be changed according to the voltage level of the first power source VEH, which is changed in the one frame period FP.

For example, as shown in FIG. 6A, the display device may supply the data signal Vdata having a fourth voltage level VD1 in the display scan period DSP and supply the data signal Vdata having a fifth voltage level VD2 in the bias scan periods BSP1 and BSP2 such that the voltage applied to the gate electrode of the first transistor M1 is not increased even though the first power source VEH is changed from the first voltage level VE1 to the second voltage level VE2. The fifth voltage level VD2 may be lower than the fourth voltage level VD1.

Even when the voltage level of the first power source VEH is changed, an increase in voltage of the third node N3 according to an increase in voltage level of the first power source VEH and a decrease in voltage of the third node N3 according to a decrease in voltage level of the data signal Vdata are cancelled with each other by the coupling of the parasitic capacitor between the second transistor M2 and the first transistor M1, so that the voltage stored in the storage capacitor Cst is stably maintained. Thus, during the one frame period FP, the pixel PXij can constantly emit light with a luminance corresponding to a data signal supplied in the display scan period DSP of the corresponding frame period FP.

Similarly, when the voltage level of the first power source VEH is changed once more in the second bias scan period BSP2 (i.e., when the first power source VEH having the third voltage level VE3 is supplied in the second bias scan period BSP2), the voltage level of the first power source VEH is increased in the second bias scan period BSP2, and therefore, the voltage stored in the storage capacitor Cst may be fluctuated.

Accordingly, in the display device in accordance the embodiments of the present disclosure, the voltage level of the data signal Vdata supplied from the data line Dj may be changed corresponding to the voltage level of the first power source VEH, which is changed in the bias scan periods BSP1 and BSP2.

For example, as shown in FIG. 6B, the display device may supply the data signal Vdata having the fifth voltage level VD2 in the first bias scan period BSP1 and supply the data signal Vdata having a sixth voltage level VD3 in the second bias scan period BS2 such that the voltage applied to the gate electrode of the first transistor M1 is not increased corresponding to the first power source VEH changed from the second voltage level VE2 to the third voltage level VE3. The sixth voltage level VD3 may be lower than the fifth voltage level VD2.

An increase in voltage of the third node N3 according to the increase in voltage level of the first power source VEH and a decrease in voltage of the third node N3 according to the decrease in voltage level of the data signal Vdata are cancelled with each other, so that the voltage stored in the storage capacitor Cst is stably maintained. Thus, during the one frame period FP, the pixel PXij can constantly emit light with a luminance corresponding to a data signal supplied in the display scan period DSP of the corresponding frame period FP.

The voltage level (e.g., the fifth voltage level VD2 and/or the sixth voltage level VD3) of the data signal Vdata, which is changed in the bias scan periods BSP1 and BSP2, may be experimentally determined by considering a circuit design, etc. (e.g., an arrangement relationship between the transistors, etc.) such that the voltage stored in the storage capacitor Cst can be constantly maintained by the coupling of the parasitic capacitor between the second transistor M2 and the first transistor M1, corresponding to the voltage level (e.g., the second voltage level VE2 and/or the third voltage level VE3) of the first power source VEH, which is changed in the bias scan periods BSP1 and BSP2.

Although a case where the bias scan period includes two bias scan periods BSP1 and BSP2 has been exemplarily described in FIGS. 6A and 6B, the number of bias scan periods according to the invention is not limited thereto. In another embodiment, for example, the number of bias scan periods may be one or three or more.

When the number of bias scan periods is 3 or more, as described in FIG. 6B, the display device may change the voltage level of the first power source VEH for each bias scan period as the length of one frame period FP is lengthened. In an example, when the number of bias scan periods is 3, the display device may supply the first power source VEH having a second voltage level (e.g., VE2 shown in FIG. 6A) in a first bias scan period (e.g., BSP1 shown in FIG. 6B), supply the first power source VEH having a third voltage level (e.g., VE3 shown in FIG. 6B) higher than the second voltage level in a second bias scan period (e.g., BSP2 shown in FIG. 6B) after the first bias scan period, and supply the first power source VEH having a voltage level higher than the second voltage level in a third bias scan period after the second bias scan period.

The display device (e.g., the display device 1000 shown in FIG. 1) may again supply the first power source VEH having the first voltage level VE1 to the pixel PXij in a display scan period DSP of a next frame period FP, after the bias scan periods BSP1 and BSP2 in the one frame period FP are ended.

Figure 7A:
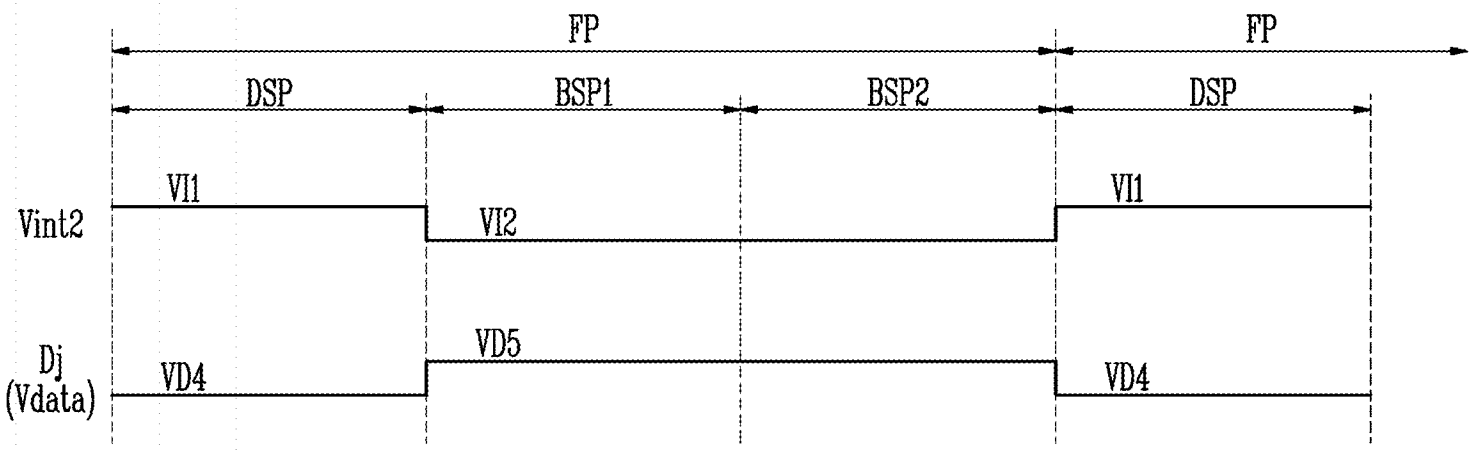
FIGS. 7A and 7B are timing diagrams illustrating examples of a voltage of a second initialization power source and a data signal, which are supplied to the pixel shown in FIG. 3.
Figure 7B:
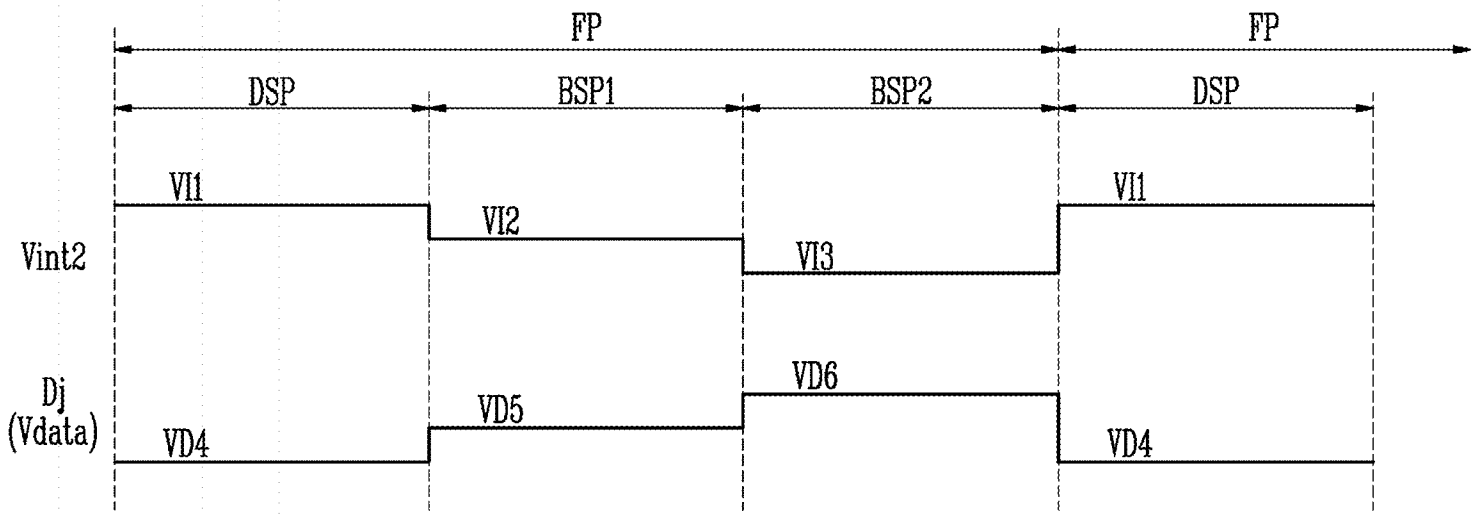

FIGS. 7A and 7B are timing diagrams illustrating examples of the voltage of the second initialization power source and the data signal, which are supplied to the pixel shown in FIG. 3.

Referring to FIGS. 3, 5, and 7A, the voltage level of the second initialization power source Vint2 may be changed in one frame period FP. For example, the second initialization power source Vint2 may have a seventh voltage level V11 in a display scan period DSP, and have an eighth voltage level V12 in at least one bias scan period BSP1 and BSP2. The eighth voltage level V12 may be lower than the seventh voltage level V11.

The length of the one frame period FP is further lengthened as a driving frequency becomes lower. A degree to which a driving current is unintentionally changed by influence of a bias state of the first transistor M1 may become more serious. Accordingly, the luminance of a displayed image may be fluctuated (e.g., the luminance increases).

In the display device in accordance with embodiments of the present disclosure, in order to prevent an increase in luminance of a displayed image, the voltage level of the second initialization power source Vint2 is changed in the one frame period FP, so that the fluctuation of image luminance due to the influence of the bias state of the first transistor M1 can be more effectively prevented (i.e., eliminated). For example, when the voltage level of the second initialization power source Vint2 applied to the light emitting element LD is decreased, an initialization amount of the parasitic capacitor of the light emitting element LD is increased, so that an increase in image luminance is controlled. Thus, the luminance of the display image is lowered, so that the fluctuation of image luminance can be further minimized.

Accordingly, in the display in accordance with embodiments of the present disclosure, as shown in FIG. 7A, the second initialization power source Vint having a voltage level (i.e., the eighth voltage level V12) lower than that in the display scan period DSP is supplied to the light emitting element LD included in the pixel PXij in the bias scan periods BSP1 and BSP2, so that the fluctuation of image luminance in the bias scan periods BSP1 and BSP2 can be more effectively prevented (i.e., eliminated).

Referring to FIG. 7B, in an embodiment, the voltage level of the second initialization power source Vint2 may be changed in the bias scan periods BSP1 and BSP2. For example, the second initialization power source Vint2 may have the eighth voltage level V12 in the first bias scan period BSP1, and have a ninth voltage level V13 in the second bias scan period BSP2. The ninth voltage level V13 may be lower than the eighth voltage level.

Similar to as described with reference to FIG. 7A, a degree to which the driving current is changed may become serious as a display period is lengthened even in the bias scan periods BSP1 and BSP2. That is, a degree to which the driving current is changed in the second bias scan period BSP2 may become more serious than that in the first bias scan period BSP1.

Accordingly, in the display in accordance with embodiments of the present disclosure, as shown in FIG. 7B, the second initialization power source Vint2 having a voltage level (i.e., the ninth voltage level V13) lower than that in the first bias scan period BSP1 is supplied to the pixel PXij in the second bias scan period BSP2, so that the fluctuation of image luminance in the bias scan periods BSP1 and BSP2 (or only the second bias scan period BSP2) can be more effectively prevented (i.e., eliminated).

As the voltage level of the second initialization power source Vint2 is changed, i.e., as the voltage level of the second initialization power source Vint2 is decreased in the bias scan periods BSP1 and BSP2, a voltage applied to the gate electrode (i.e., the third node N3) of the first transistor M1 (i.e., a voltage stored in the storage capacitor Cst) may be fluctuated (e.g., a voltage level of the voltage applied to the third node N3 is changed (i.e., decreased) corresponding to a data signal Vdata) by influence of a parasitic capacitor between the first node N1 and the third node N3 (i.e., a parasitic capacitor between the source electrode and the gate electrode of the first transistor M1).

In the display device in accordance with embodiments of the present disclosure, a voltage level of the data signal Vdata supplied from the data line Dj may be changed corresponding to the voltage level of the second initialization power source Vint2, which is changed in the one frame period FP.

For example, as shown in FIG. 7A, the display device may supply the data signal Vdata having a tenth voltage level VD4 in the display scan period DSP and supply the data signal Vdata having an eleventh voltage level VD5 in the bias scan periods BSP1 and BSP2 such that the voltage applied to the gate electrode of the first transistor M1 is not decreased corresponding to the second initialization power source Vint2 changed from the seventh voltage level V11 to the eighth voltage level V12. The eleventh voltage level VD5 may be higher than the tenth voltage level VD4.

Even when the voltage level of the second initialization power source Vint2 is changed, a decrease in voltage of the third node N3 according to a decrease in voltage level of the second initialization power source Vint2 and an increase in voltage of the third node N3 according to an increase in voltage level of the data signal Vdata are cancelled with each other by the coupling of the parasitic capacitor between the second transistor M2 and the first transistor M1, so that the voltage stored in the storage capacitor Cst is stably maintained. Thus, during the one frame period FP, the pixel PXij can constantly emit light with a luminance corresponding to a data signal supplied in the display scan period DSP of the corresponding frame period FP.

Similarly, when the voltage level of the second initialization power source Vint2 is changed once more in the second bias scan period BSP2 (i.e., when the second initialization power source Vint2 having the ninth voltage level V13 is supplied in the second bias scan period BSP2), the voltage level of the second initialization power source Vint2 is decreased in the second bias scan period BSP2, and therefore, the voltage stored in the storage capacitor Cst may be fluctuated.

Accordingly, in the display device in accordance with embodiments of the present disclosure, a voltage level corresponding to the data signal Vdata supplied from the data line Dj may be changed according to the voltage level of the second initialization power source Vint2, which is changed in the bias scan periods BSP1 and BSP2.

For example, as shown in FIG. 7B, the display device may supply the data signal Vdata having the eleventh voltage level VD5 in the first bias scan period BSP1 and supply the data signal Vdata having a twelfth voltage level VD6 in the second bias scan period BS2 such that the voltage applied to the gate electrode of the first transistor M1 is not decreased corresponding to the second initialization power source Vint changed from the eighth voltage level V12 to the ninth voltage level V13. The twelfth voltage level may be higher than the eleventh voltage level VD5.

A decrease in voltage of the third node N3 according to the decrease in voltage level of the second initialization power source Vint2 and an increase in voltage of the third node N3 according to the increase in voltage level of the data signal Vdata are cancelled with each other, so that the voltage stored in the storage capacitor Cst is stably maintained. Thus, during the one frame period FP, the pixel PXij can constantly emit light with a luminance corresponding to a data signal supplied in the display scan period DSP of the corresponding frame period FP.

The voltage level (e.g., the eleventh voltage level VD5 and/or the twelfth voltage level VD6) of the data signal Vdata, which is changed in the bias scan periods BSP1 and BSP2, may be experimentally determined by considering a circuit design, etc. (e.g., an arrangement relationship between the transistors, etc.) such that the voltage stored in the storage capacitor Cst can be constantly maintained by the coupling of the parasitic capacitor between the second transistor M2 and the first transistor M1, corresponding to the voltage level (e.g., the eighth voltage level V12 and/or the ninth voltage level V13) of the second initialization power source Vint2, which is changed in the bias scan periods BSP1 and BSP2.

When the number of bias scan periods is 3 or more, similarly to as described in FIG. 6B, the display device may change the voltage level of the second initialization power source Vint2 for each bias scan period as the length of one frame period FP is lengthened. In an example, when the number of bias scan periods is 3, the display device may supply the second initialization power source Vint2 having an eighth voltage level (e.g., V12 shown in FIG. 7B) in a first bias scan period (e.g., BSP1 shown in FIG. 7B), supply the second initialization power source Vint2 having a ninth voltage level (e.g., V13 shown in FIG. 7B) lower than the eighth voltage level in a second bias scan period (e.g., BSP2 shown in FIG. 7B) after the first bias scan period, and supply the second initialization power source Vint2 having a voltage level lower than the ninth voltage level in a third bias scan period after the second bias scan period.

Figure 8A:
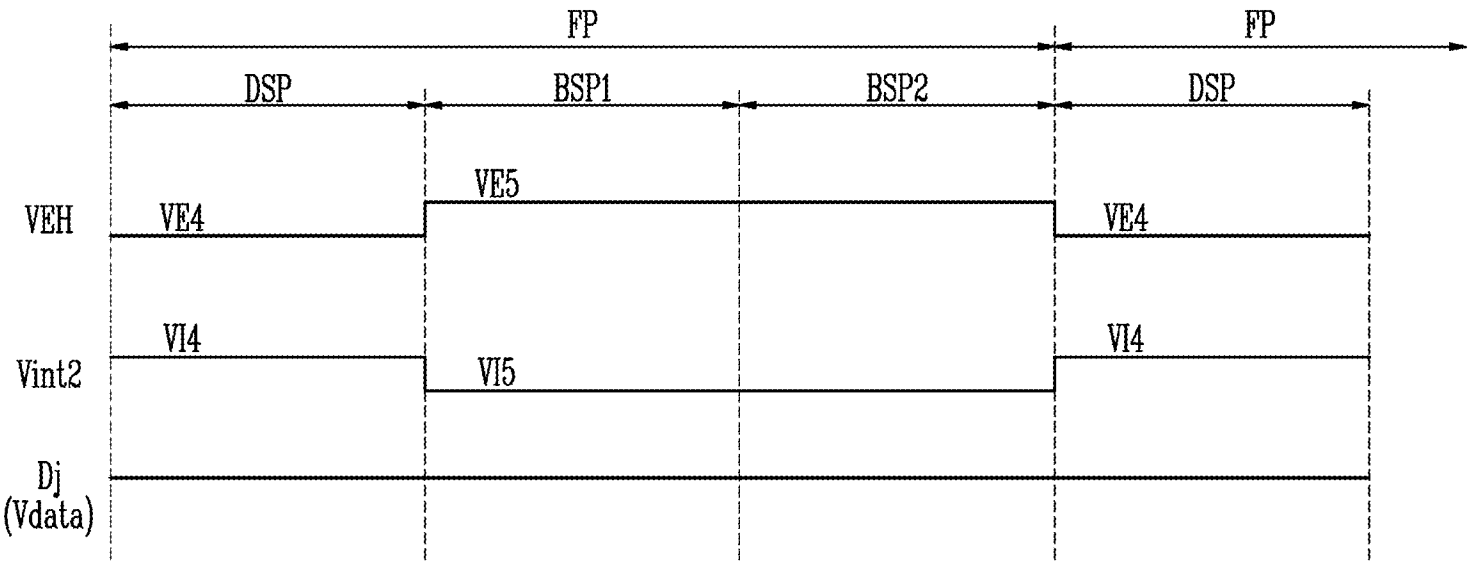
FIGS. 8A and 8B are timing diagrams illustrating examples of a voltage of the first power source, a voltage of the second initialization power source, and a data signal, which are supplied to the pixel shown in FIG. 3.
Figure 8B:
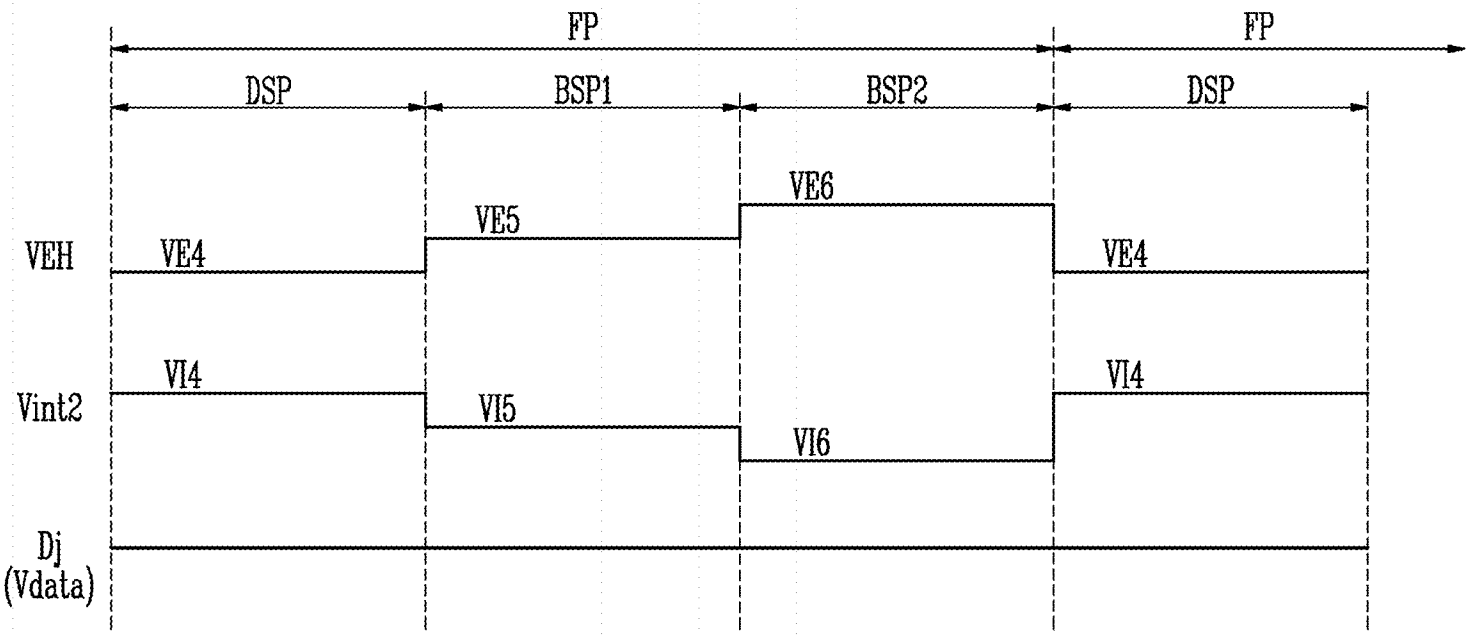
Figure 9A:
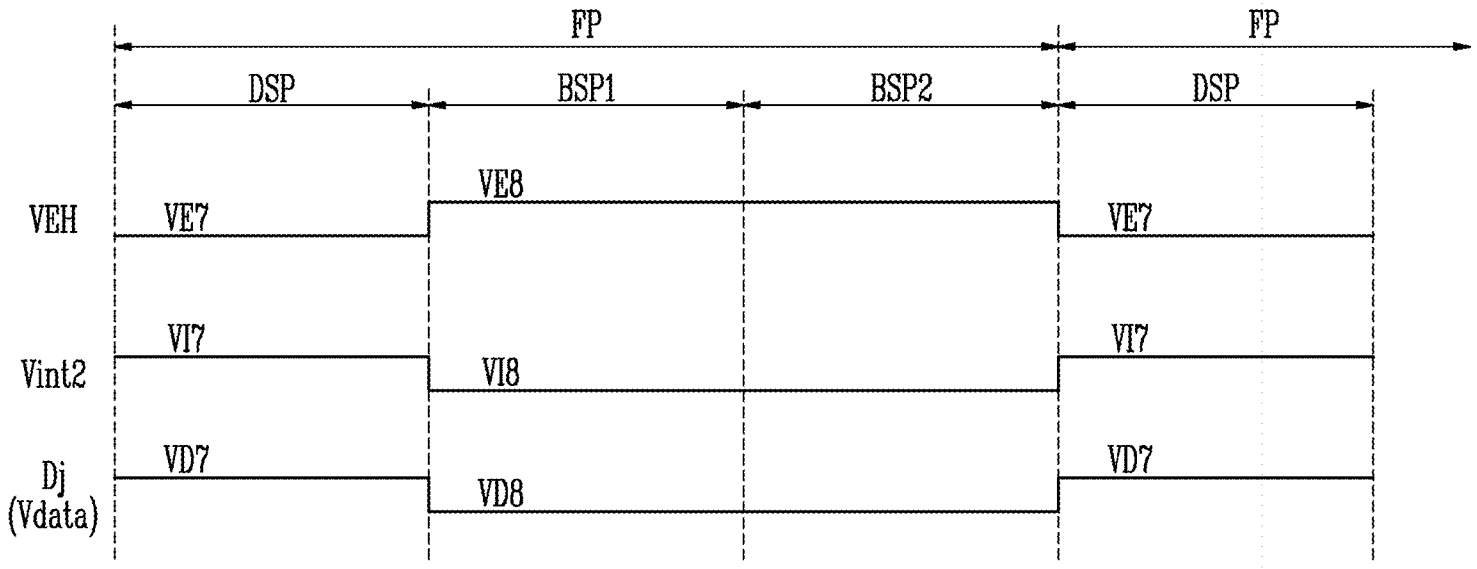
FIGS. 9A and 9B are timing diagrams illustrating examples of a voltage of the first power source, a voltage of the second initialization power source, and a data signal, which are supplied to the pixel shown in FIG. 3.
Figure 9B:
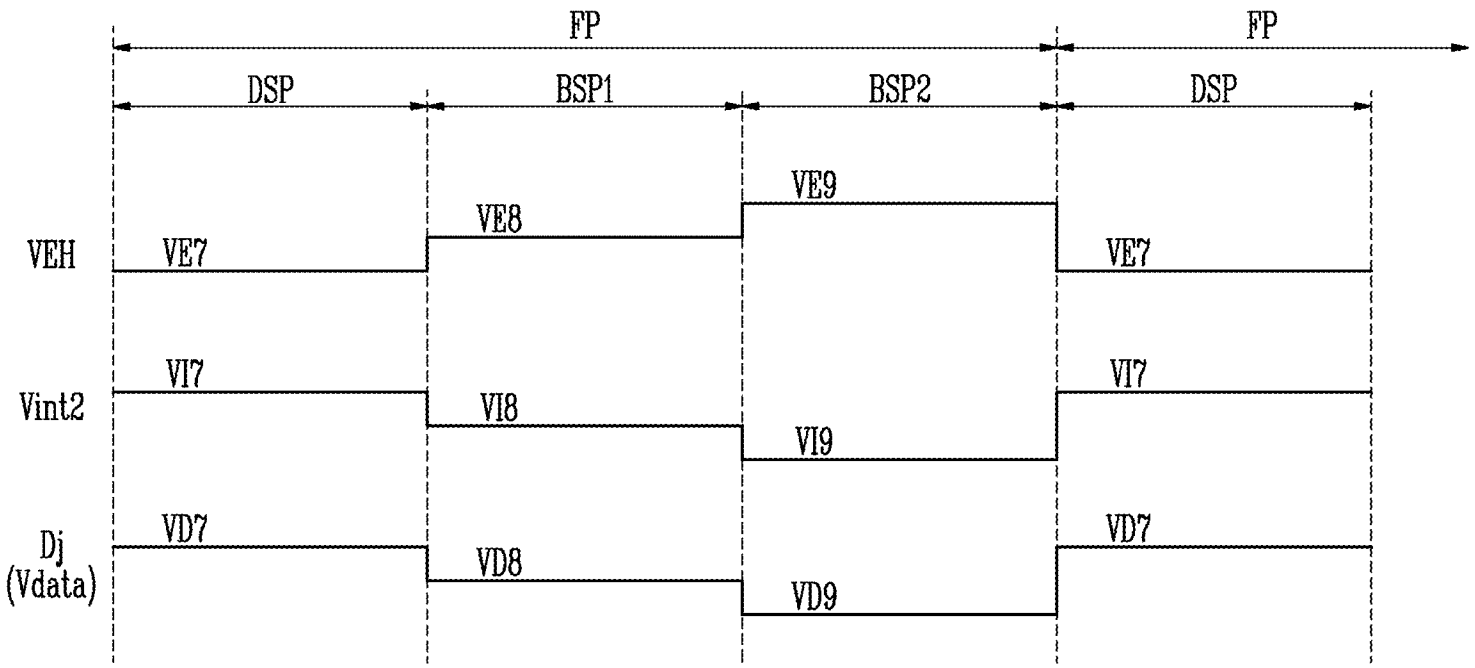

FIGS. 8A and 8B are timing diagrams illustrating examples of the voltage of the first power source, the voltage of the second initialization power source, and the data signal, which are supplied to the pixel shown in FIG. 3. FIGS. 9A and 9B are timing diagrams illustrating examples of the voltage of the first power source, the voltage of the second initialization power source, and the data signal, which are supplied to the pixel shown in FIG. 3.

Referring to FIGS. 3, 5, and 8A to 9B, the voltage of the first power source VEH and the voltage level of the second initialization power source Vint2 may be changed in one frame period FP.

For example, as shown in FIGS. 8A and 9A, the first power source VEH may have a first voltage level VE4 and VE7 in a display scan period DSP, and have a second voltage level VE5 and VE8 higher than the first voltage level VE4 and VE7 in at least one bias scan period BSP1 and BSP2. In addition, the second initialization power source Vint2 may have a seventh voltage level V14 and V17 in the display scan period DSP, and have an eighth voltage level V15 and V18 lower than the seventh voltage level V14 and V17.

In another example, as shown in FIGS. 8B and 9B, the first power source VEH may have the first voltage level VE4 and VE7 in the display scan period DSP, have the second voltage level VE5 and VE8 higher than the first voltage level VE4 and VE7 in a first bias scan period BSP1, and have a third voltage level VE6 and VE9 higher than the second voltage level VE5 and VE8 in a second bias scan period BSP2. In addition, the second initialization power source Vint2 may have the seventh voltage level V14 and V17 in the display scan period DSP, have the eighth voltage level V15 and V18 lower than the seventh voltage level V14 and V17 in the first bias scan period BSP1, and have a ninth voltage level V16 and V19 lower than the eighth voltage level V15 and V18 in the second bias scan period BSP2.

As described with reference to FIGS. 6A to 7B, the fluctuation of image luminance due to the influence of the bias state of the first transistor M1 can be more efficiently prevented (i.e., eliminated) by changing the voltage level of the first power source VEH and/or the voltage level of the second initialization power source Vint2.

This will be described in detail with reference to FIGS. 3 and 8A, when the voltage level of the first power source VEH is increased from the first voltage level VE4 to the second voltage level VE5 in the bias scan periods BSP1 and BSP2, the voltage applied to the gate electrode (i.e., the third node N3) of the first transistor M1 may be increased due to influence of a parasitic capacitor between the first node N1 and the third node N3 (i.e., a parasitic capacitor between the source electrode and the gate electrode of the first transistor M1). In addition, since the voltage level of the second initialization power source Vint2 is decreased from the seventh voltage level V14 to the eighth voltage level V15 in the bias scan periods BSP1 and BSP2, the voltage applied to the gate electrode (i.e., the third node N3) of the first transistor M1 may be decreased due to influence of a parasitic capacitor between the fourth node N4 and the third node N3. Accordingly, in embodiments of the present disclosure, an increase in the voltage of the third node N3 according to the increase in the voltage level of the first power source VEH and a decrease in the voltage of the third node N3 according to the decrease in the voltage level of the second initialization power source Vint2 are cancelled with each other, so that the voltage of the third node can be stably maintained. Accordingly, in the display device in accordance with embodiments of the present disclosure, during the one frame period FP, the pixel PXij can constantly emit light with a luminance corresponding to a data signal Vdata supplied in the display scan period DSP of the corresponding frame period FP, even when although the voltage level of the data signal Vdata is not changed.

However, the present disclosure is not limited thereto. As described with reference to FIGS. 6A to 7B, in the display device in accordance with embodiments of the present disclosure, the voltage level of the data signal Vdata may be changed in the bias scan periods BSP1 and BSP2 so as to effectively prevent luminance fluctuation according to a change in hysteresis characteristic of the first transistor T1 by changing the voltage level of the first power source VEH and the voltage level of the second initialization power source Vint2 and to prevent fluctuation of the voltage of the third node N3 according to an operation of changing the voltage level of the first power source VEH and the voltage level of the second initialization power source Vint.

For example, as shown in FIG. 9A, the data signal Vdata may have a fourth voltage level VD7 in the display scan period DSP, and have a fifth voltage level VD8 higher than the fourth voltage level VD7 in the at least one bias scan period BSP1 and BSP2. In another example, as shown in FIG. 9B, the data signal Vdata may have the fourth voltage level VD7 in the display scan period DSP, have the fifth voltage level VD8 higher than the fourth voltage level VD7 in the first bias scan period BSP1, and have a sixth voltage level VD9 higher than the fifth voltage level VD8. Accordingly, a luminance variation due to the fluctuation of the voltage of the third node N3 can be more effectively prevented (i.e., eliminated).

Figure 10:
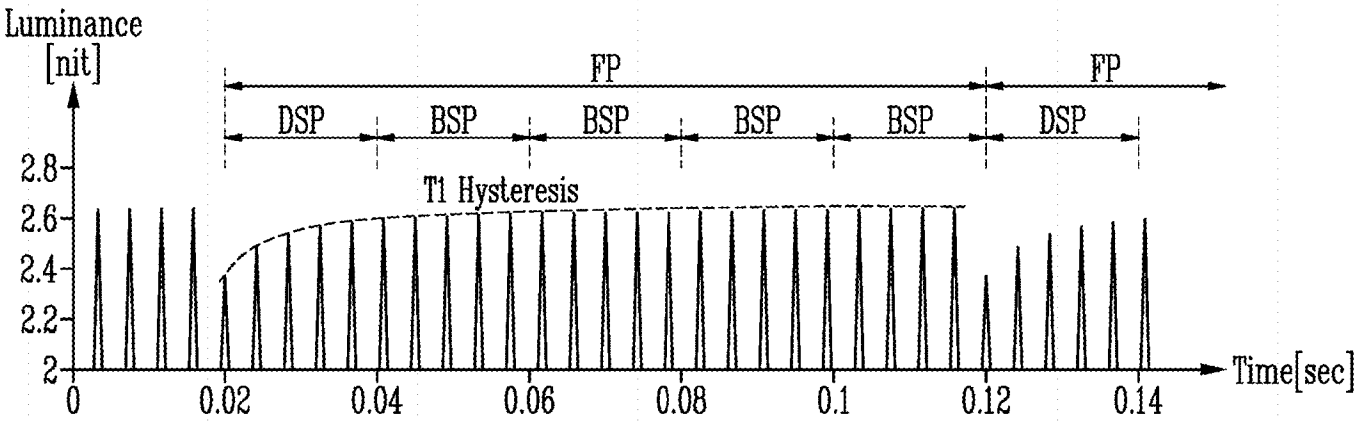
FIG. 10 (Related Art)
FIG. 10 is a graph illustrating an example of a luminance of an image displayed by a display device in accordance with a related art.
Figure 11:
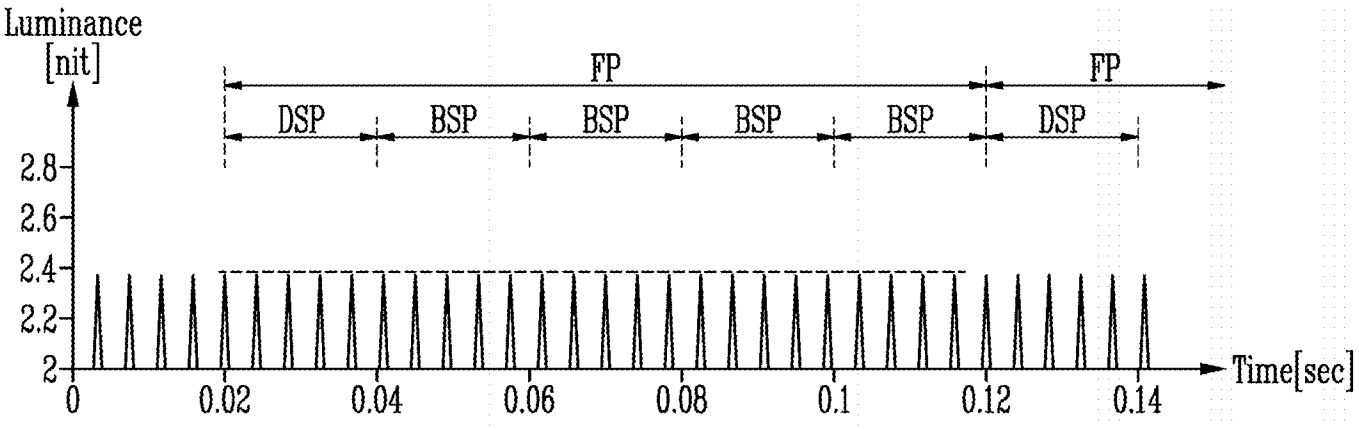
FIG. 11 is a graph illustrating an example of a luminance of an image displayed by the display device in accordance with embodiments of the present disclosure.

FIG. 10 is a graph illustrating an example of a luminance [unit: nit] of an image displayed by a display device in accordance with a related art. FIG. 11 is a graph illustrating an example of a luminance of an image displayed by the display device in accordance with embodiments of the present disclosure.

Referring to FIGS. 10 and 11, as described with reference to FIGS. 3 and 6A to 9B, in the display device in accordance with the related art, a luminance may be changed (e.g., the luminance is increased) by a change in hysteresis characteristic of the first transistor T1 (illustrated as T1 Hysteresis in FIG. 10) as a display period is lengthened in one frame period FP, i.e., as approaching a bias scan period BSP from a display scan period DSP (see FIG. 10). On the other hand, in the display device in accordance with embodiments of the present disclosure, the voltage level of the first power source VEH and/or the voltage level of the second initialization power source Vint2 are/is changed in the one frame period FP, so that luminance fluctuation according to a change in hysteresis characteristic of the first transistor T1 can be effectively prevented. Accordingly, a luminance can be constantly maintained during the one frame period FP (see FIG. 11).

Figure 12:
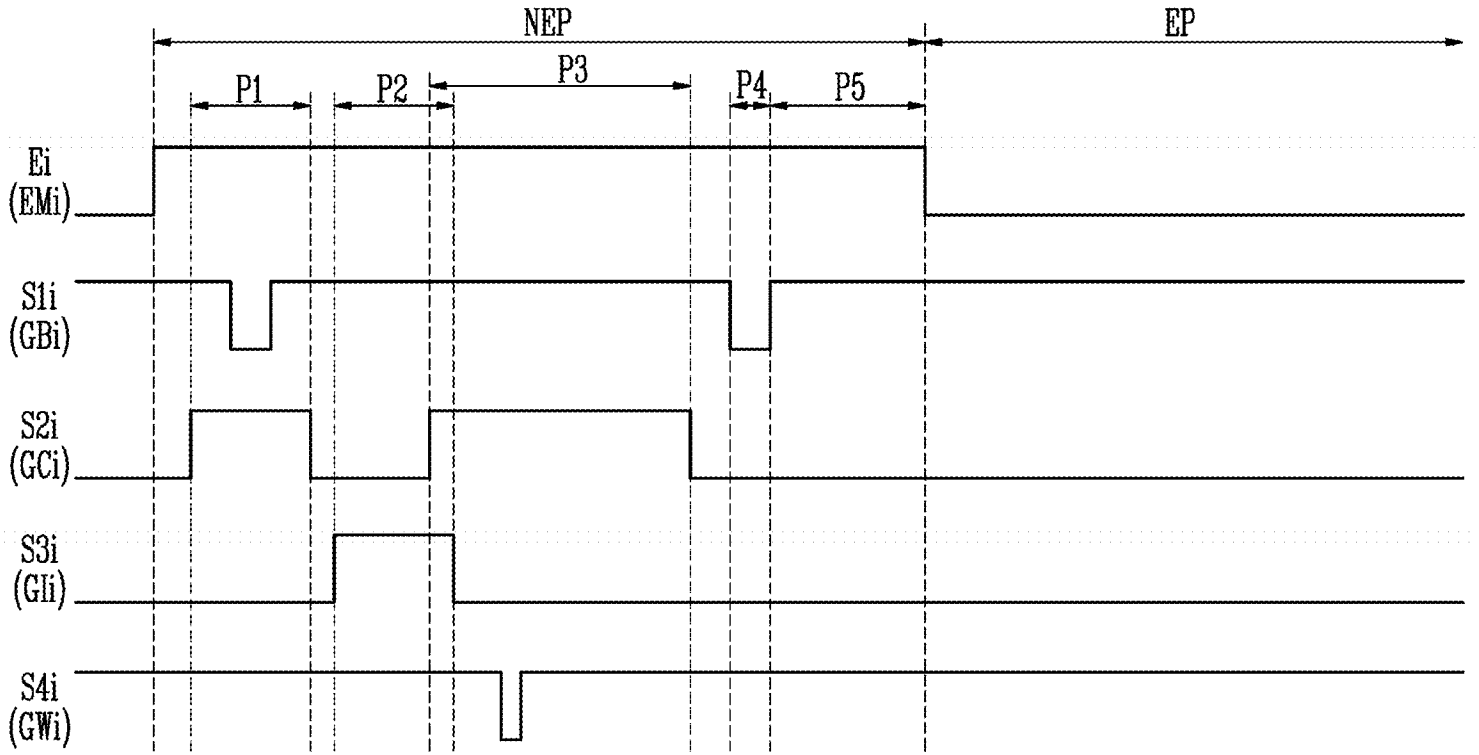
FIG. 12 is a timing diagram illustrating another example of the signals supplied to the pixel shown in FIG. 3.
Figure 13:
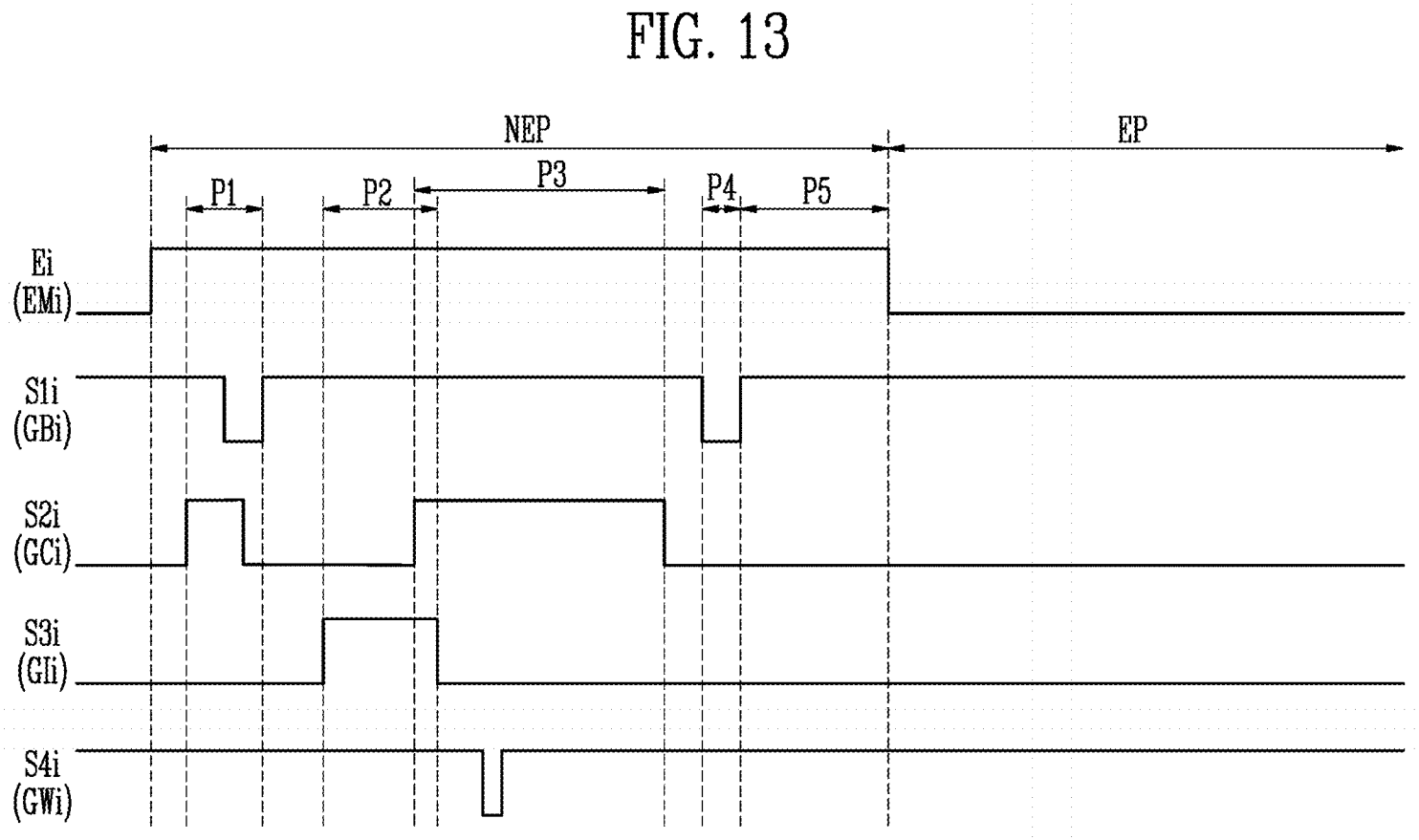
FIG. 13 is a timing diagram illustrating still another example of the signals supplied to the pixel shown in FIG. 3.

FIG. 12 is a timing diagram illustrating another example of the signals supplied to the pixel shown in FIG. 3. FIG. 13 is a timing diagram illustrating still another example of the signals supplied to the pixel shown in FIG. 3.

The timing diagrams shown in FIGS. 12 and 13 are identical or similar to the timing diagram shown in FIG. 4, except a width and a supply timing of some scan signals. Therefore, components identical or corresponding to those in the timing diagram shown in FIG. 4 are designated by like reference numerals, and their overlapping descriptions will be omitted.

Referring to FIGS. 3, 12, and 13, the non-emission period NEP of the display scan period may include first to fifth periods P1 to P5.

In an embodiment, as shown in FIG. 12, the second period P2 and the third period P3 may partially overlap with each other. That is, in a state in which the seventh transistor M7 is turned on in response to the third scan signal GIi, the third transistor M3 may be turned on in response to the second scan signal GCi. Since the voltage of the first initialization power source Vint1 has already been supplied to the third node N3, and the first transistor M1 has been on-biased, a characteristic of the first transistor M1 according to signal supply shown in FIG. 12 may be similar to that of the first transistor M1 according to driving of the third period P3.

In an embodiment, as shown in FIG. 13, the supply of the first scan signal GBi may be suspended after the supply of the second scan signal GCi is suspended in the first period P1. In the first period P1, the fourth transistor M4 may be turned on after the third transistor M3 is turned on, and be turned off after the third transistor M3 is turned off. Since a voltage similar to that of the first power source VEH is supplied to the second node N2, a characteristic of the first transistor M1 in the first period shown in FIG. 13 may be similar to that of the first transistor M1 in the first period P1 shown in FIG. 4.

As described above, some scan signals may be output with a predetermined margin according to a waveform of clock signals supplied to the scan driver (200 shown in FIG. 1), an output characteristic of a circuit included in the scan driver (200 shown in FIG. 1), and the like.

Figure 14:
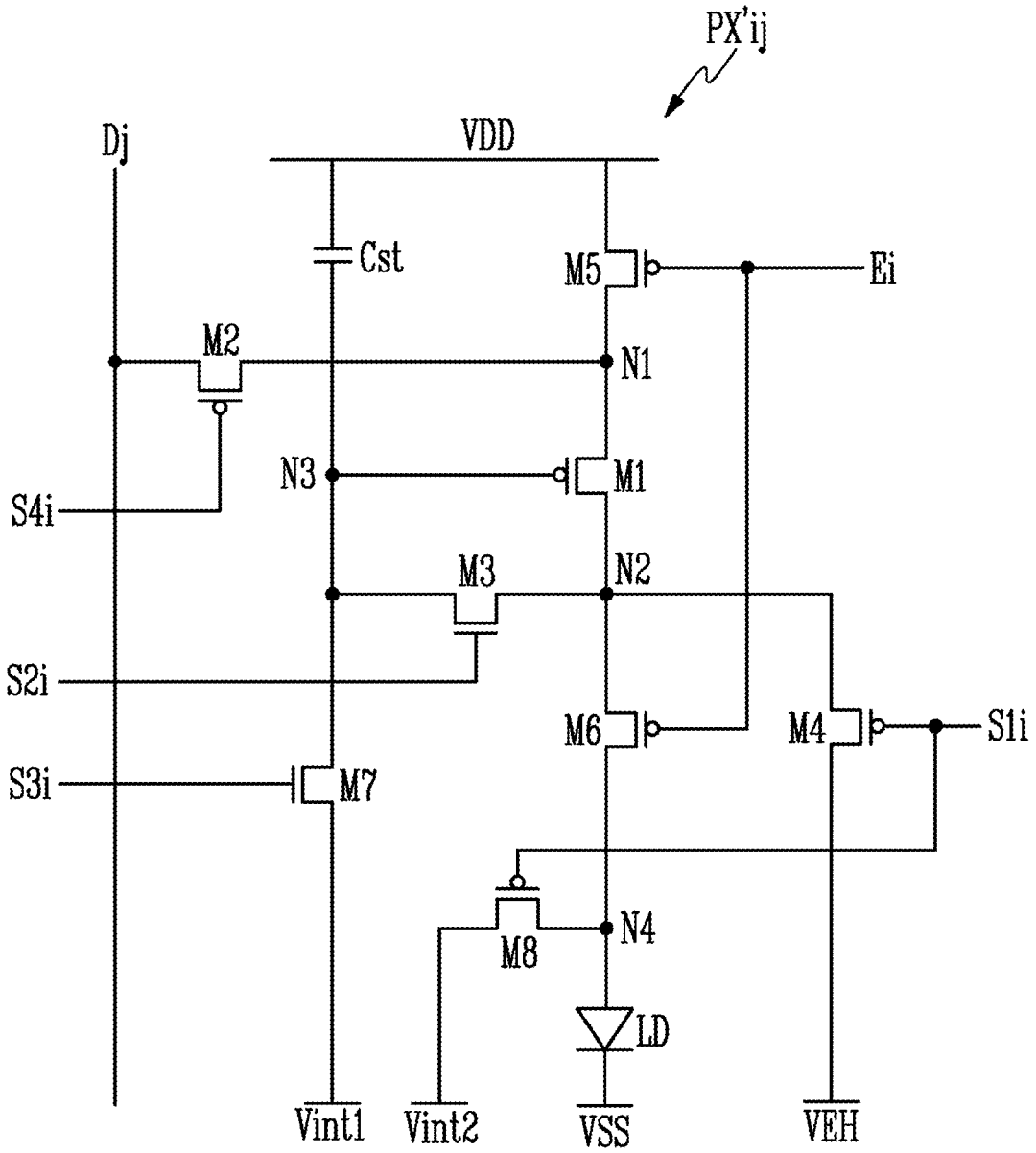
FIG. 14 is a circuit diagram illustrating another example of the pixel included in the display device shown in FIG. 1.

FIG. 14 is a circuit diagram illustrating another example of the pixel included in the display device shown in FIG. 1.

A configuration and an operation of a pixel PX'ij shown in FIG. 14 are identical to those of the pixel PXij described with reference to FIG. 3, except a fourth transistor M4. Therefore, components identical or corresponding to those of the pixel PXij described with reference to FIG. 3 are designated by like reference numerals, and their overlapping descriptions will be omitted.

Referring to FIG. 14, the pixel PX'ij may include a light emitting element LD, first to eighth transistors M1 to M8, and a storage capacitor Cst.

In an embodiment, one electrode of the first transistor M1 may be connected to a second node N2, and the other electrode of the first transistor M1 may be connected to the first power source VEH. The fourth transistor M4 may supply the voltage of the first power source VEH to the second node N2 in response to the first scan signal supplied from the first scan line S1*i*. As described above, a voltage for an on-bias may be supplied to any one of a source electrode and a drain electrode of the first transistor M1. For example, the pixel PXij shown in FIG. 3 supplies the voltage for the on-bias to the source electrode of the first transistor M1, and the pixel PX'ij shown in FIG. 14 supplies the voltage for the on-bias to the drain electrode of the first transistor M1.

In accordance with the present disclosure, the pixel may be applied with the voltage of the first power source for supplying a bias voltage to the driving transistor and the voltage of the second initialization power source for supplying an initialization voltage to the light emitting element. The voltage level of the first power source and/or the voltage level of the second initialization power source may be changed during one frame period. Accordingly, display quality deterioration due to a change in hysteresis characteristic of the driving transistor can be effectively prevented (i.e., eliminated).

Further, in accordance with the present disclosure, the pixel may be applied with a data signal having a voltage level changed during one frame period, as the voltage level of the first power source and/or the voltage level of the second initialization power source are/is changed. Accordingly, fluctuation of a voltage stored in the storage capacitor is effectively prevented, and thus the luminance of a display image can be constantly maintained.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A pixel comprising:

a light emitting element;

a first transistor connected between a first node and a second node, and which controls a driving current supplied to the light emitting element, according to a voltage of a third node connected to a gate electrode of the first transistor;

a second transistor connected between a data line and the first node, and which is turned on in response to a fourth scan signal;

a third transistor connected between the second node and the third node, and which is turned on in response to a second scan signal;

a fourth transistor which is turned on in response to a first scan signal to apply a voltage of a first power source to the first transistor;

a fifth transistor connected between a driving power source and the first node, and which is turned off in response to an emission control signal;

a sixth transistor connected between the second node and a first electrode of the light emitting element, and which is turned off in response to the emission control signal; and a seventh transistor connected between the third node and a second power source, and which is turned on in response to a third scan signal, wherein a level of the voltage of the first power source is changed in one frame period.

2. The pixel of claim 1, wherein the one frame period includes:

a display scan period in which the fourth scan signal is supplied to the second transistor such that a data signal supplied through the data line is written to the first node, and the first scan signal is supplied to the fourth transistor; and at least one bias scan period in which the fourth scan signal is not supplied to the second transistor, and the first scan signal is supplied to the fourth transistor.

3. The pixel of claim 2, wherein the first power source has a first voltage level in the display scan period, and has a second voltage level different from the first voltage level in the at least one bias scan period.

4. The pixel of claim 3, wherein the data signal supplied through the data line has a fourth voltage level in the display scan period, and has a fifth voltage level different from the fourth voltage level in the at least one bias scan period.

5. The pixel of claim 3, further comprising an eighth transistor connected between the first electrode of the light emitting element and a third power source, and which is turned on in response to the first scan signal, wherein the third power source has a seventh voltage level in the display scan period, and has an eighth voltage level different from the seventh voltage level in the at least one bias scan period.

6. The pixel of claim 2, wherein the at least one bias scan period includes a first bias scan period and a second bias scan period after the first bias scan period, and wherein the first power source has a first voltage level in the display scan period, has a second voltage level different from the first voltage level in the first bias scan period, and has a third voltage level different from each of the first voltage level and the second voltage level in the second bias scan period.

7. The pixel of claim 6, wherein the data signal supplied through the data line has a fourth voltage level in the display scan period, has a fifth voltage level different from the fourth voltage level in the first bias scan period, and has a sixth voltage level different from each of the fourth voltage level and the fifth voltage level in the second bias scan period.

8. The pixel of claim 6, further comprising an eighth transistor connected between the first electrode of the light emitting element and a third power source, and which is turned on in response to the first scan signal, wherein the third power source has a seventh voltage level in the display scan period, has an eighth voltage level different from the seventh voltage level in the first bias scan period, and has a ninth voltage level different from each of the seventh voltage level and the eighth voltage level in the second bias scan period.

9. The pixel of claim 1, wherein one electrode of the fourth transistor is connected to the first node.

10. The pixel of claim 1, wherein one electrode of the fourth transistor is connected to the second node.

11. A display device comprising:

a pixel including a first transistor connected between a first node and a second node to generate a driving current, the pixel being connected to a first scan line, a second scan line, a third scan line, a fourth scan line, an emission control line, and a data line;

an emission driver which supplies an emission control signal to the emission control line;

a scan driver which supplies first to fourth scan signals to the first to fourth scan lines, respectively, in a period in which the emission control signal is supplied;

a data driver which supplies a data signal to the data line;

a power supply which supplies, to the pixel, a voltage of a driving power source, a voltage of a first power source, a voltage of a second power source, and a voltage of a third power source; and a timing controller which controls driving of the scan driver, the emission driver, the data driver, and the power supply, wherein the first scan signal controls a timing at which the voltage of the first power source is supplied to the first node or the second node, and wherein the power supply changes a level of the voltage of the first power source in one frame period.

12. The display device of claim 11, wherein the pixel further includes:

a light emitting element;

a second transistor connected between the data line and the first node, and which is turned on in response to the fourth scan signal;

a third transistor connected between the second node and a third node, and which is turned on in response to the second scan signal, the third node corresponding to a gate electrode of the first transistor;

a fourth transistor which is turned on in response to the first scan signal to apply the voltage of the first power source to the first transistor;

a fifth transistor connected between the driving power source and the first node, and which is turned off in response to the emission control signal;

a sixth transistor connected between the second node and a first electrode of the light emitting element, and which is turned off in response to the emission control signal; and a seventh transistor connected between the third node and the second power source, and which is turned on in response to the third scan signal.

13. The display device of claim 12, wherein the one frame period includes a display scan period and at least one bias scan period, wherein, in the display scan period, the scan driver supplies the first scan signal through the first scan line, and supplies the fourth scan signal through the fourth scan line, and wherein, in the at least one bias scan period, the scan driver supplies the first scan signal through the first scan line, and does not supply the fourth scan signal.

14. The display device of claim 13, wherein the power supply:

supplies the voltage of the first power source having a first voltage level in the display scan period; and supplies the voltage of the first power source having a second voltage level different from the first voltage level in the at least one bias scan period.

15. The display device of claim 14, wherein the data driver:

supplies the data signal having a fourth voltage level to the data line in the display scan period; and supplies the data signal having a fifth voltage level different from the fourth voltage level to the data line in the at least one bias scan period.

16. The display device of claim 14, wherein the pixel further includes an eighth transistor connected between the first electrode of the light emitting element and the third power source, and which is turned on in response to the first scan signal, and wherein the power supply:

supplies the voltage of the third power source having a seventh voltage level in the display scan period; and supplies the voltage of the third power source having an eighth voltage level different from the seventh voltage level in the at least one bias scan period.

17. The display device of claim 13, wherein the at least one bias scan period includes a firs bias scan period and a second bias scan period after the first bias scan period, wherein the power supply:

supplies the voltage of the first power source having a first voltage level in the display scan period;

supplies the voltage of the first power source having a second voltage level different from the first voltage level in the first bias scan period; and supplies the voltage of the first power source having a third voltage level different from each of the first voltage level and the second voltage level in the second bias scan period.

18. The display device of claim 17, wherein the data driver:

supplies the data signal having a fourth voltage level to the data line in the display scan period;

supplies the data signal having a fifth voltage level different from the fourth voltage level to the data line in the first bias scan period; and supplies the data signal having a sixth voltage level different from each of the fourth voltage level and the fifth voltage level to the data line in the second bias scan period.

19. The display device of claim 17, wherein the pixel further includes an eighth transistor connected between the first electrode of the light emitting element and the third power source, and which is turned on in response to the first scan signal, and wherein the power supply:

supplies the voltage of the third power source having a seventh voltage level in the display scan period;

supplies the voltage of the third power source having an eighth voltage level different from the seventh voltage level in the first bias scan period; and supplies the voltage of the third power source having a ninth voltage level different from each of the seventh voltage level and the eighth voltage level in the second bias scan period.

20. The display device of claim 13, wherein the emission driver supplies the emission control signal in each of a first non-emission period of the display scan period and a second non-emission period of the at least one bias scan period, and wherein the scan driver:

supplies the second scan signal through the second scan line and supplies the third scan signal through the third scan line in the first non-emission period; and does not supply the second scan signal and the third scan signal in the second non-emission period.

* * * * *